US009391375B1

(12) United States Patent
Bales et al.

(10) Patent No.: US 9,391,375 B1
(45) Date of Patent: Jul. 12, 2016

(54) WIDEBAND PLANAR RECONFIGURABLE POLARIZATION ANTENNA ARRAY

(71) Applicant: The United States of America as represented by the Secretary of the Navy, Washington, DC (US)

(72) Inventors: Kyle A. Bales, San Diego, CA (US); Christopher J. Meagher, San Diego, CA (US)

(73) Assignee: THE UNITED STATES OF AMERICA AS REPRESENTED BY THE SECRETARY OF THE NAVY, Washington, DC (US)

( * ) Notice: Subject to any disclaimer, the term of this patent is extended or adjusted under 35 U.S.C. 154(b) by 281 days.

(21) Appl. No.: 14/039,008

(22) Filed: Sep. 27, 2013

(51) Int. Cl.

| | |
|---|---|
| ***H01Q 21/24*** | (2006.01) |
| ***H01Q 3/26*** | (2006.01) |
| ***H01Q 3/34*** | (2006.01) |
| *H01Q 21/00* | (2006.01) |

(52) U.S. Cl.
CPC ..... *H01Q 21/24* (2013.01); *H01Q 3/26* (2013.01); *H01Q 3/34* (2013.01); *H01Q 21/0075* (2013.01)

(58) Field of Classification Search
CPC . H01Q 9/0414; H01Q 9/0428; H01Q 9/0435; H01Q 9/045; H01Q 9/0457; H01Q 21/0006; H01Q 21/22; H01Q 21/24; H01Q 21/245; H01Q 21/06; H01Q 21/061; H01Q 21/065; H01Q 3/26; H01Q 3/30; H01Q 3/34; H01Q 3/36; H01Q 21/0025; H01Q 21/0075; H01Q 21/0081
See application file for complete search history.

(56) References Cited

U.S. PATENT DOCUMENTS

| | | | | |
|---|---|---|---|---|
| 3,718,935 | A | 2/1973 | Ranghelli | |
| 3,854,140 | A | 12/1974 | Ranghelli | |
| 4,197,541 | A | 4/1980 | Nemit | |
| 4,293,858 | A | 10/1981 | Hockham | |
| 4,367,474 | A | 1/1983 | Schaubert | |
| 4,543,579 | A | 9/1985 | Teshirogi | |
| 4,843,400 | A | 6/1989 | Tsao | |
| 4,866,451 | A | 9/1989 | Chen | |
| 4,903,033 | A * | 2/1990 | Tsao | H01Q 9/0414 343/700 MS |

(Continued)

OTHER PUBLICATIONS

Peter Sullivan and Daniel Schaubert, "Analysis of an Aperture Coupled Microstrip Antenna," IEEE Transactions on Antennas and Propagation, vol. AP-34, No. 8, Aug. 1986.

(Continued)

*Primary Examiner* — Sue A Purvis
*Assistant Examiner* — Patrick Holecek
(74) *Attorney, Agent, or Firm* — SPAWAR Systems Center Pacific; Kyle Eppele; Ryan J. Friedl

(57) ABSTRACT

An antenna array includes a plurality of sub-arrays each having a plurality of linearly polarized antenna elements, with each antenna element having an orthogonal feed orientation with respect to its adjacent antenna elements, and at least two feed lines each connected by at least one sub-feed line to at least two antenna elements having orthogonal feed orientations such that each antenna element is equally and progressively phase rotated. The antenna elements in at least two separate lines of the array, such as array rows or columns, are connected to a separate feed line. The antenna elements may be aperture coupled microstrip patch elements having a single slot fed by one of the sub-feed lines or cross-slot elements fed by two sub-feed lines. The sub-feed lines in a separate row or column are power combined into either one or two feed lines and may be connected to a beamformer.

19 Claims, 17 Drawing Sheets

(56) References Cited

U.S. PATENT DOCUMENTS

| | | | | |
|---|---|---|---|---|
| 4,943,809 | A | 7/1990 | Zaghloul | |
| 4,973,972 | A | 11/1990 | Huang | |
| 5,005,019 | A * | 4/1991 | Zaghloul | H01Q 9/0414 166/270.1 |
| 5,231,406 | A | 7/1993 | Sreevinas | |
| 5,294,939 | A | 3/1994 | Sanford | |
| 5,304,999 | A | 4/1994 | Roberts | |
| 5,534,877 | A | 7/1996 | Sorbello | |
| 5,661,494 | A | 8/1997 | Bondyopadhyay | |
| 5,977,929 | A | 11/1999 | Ryken | |
| 6,133,882 | A * | 10/2000 | LaFleur | H01Q 1/38 343/700 MS |
| 6,133,888 | A | 10/2000 | Mohuchy | |
| 6,288,677 | B1 | 9/2001 | Fink | |
| 6,359,599 | B2 | 3/2002 | Apostolos | |
| 6,452,568 | B1 | 9/2002 | Zidek | |
| 6,480,167 | B2 * | 11/2002 | Matthews | H01Q 3/40 343/795 |
| 6,501,426 | B2 | 12/2002 | Waterman | |
| 6,567,046 | B2 | 5/2003 | Taylor | |
| 7,068,224 | B2 * | 6/2006 | Carrender | H01Q 1/22 343/700 MS |
| 7,142,164 | B2 | 11/2006 | Legay | |
| 7,212,163 | B2 | 5/2007 | Huang | |
| 7,561,109 | B2 | 7/2009 | Montgomery | |
| 7,667,651 | B2 | 2/2010 | McKivergan | |
| 8,009,115 | B2 | 8/2011 | Walton | |
| 2006/0132359 | A1 | 6/2006 | Chang | |
| 2011/0090129 | A1 | 4/2011 | Davis | |

OTHER PUBLICATIONS

John Huang, "A Technique for an Array to Generate Circular Polarization with Linearly Polarized Elements," IEEE Transactions on Antennas and Propagation, vol. AP-34, No. 9, Sep. 1986.

C. Tsao, Y. Hwang, F. Kilburg, and F. Dietrich, "Aperture-Coupled Patch Antennas with Wide-Bandwidth and Dual-Polarization Capabilities," IEEE Antennas and Propagation Society International Symposium, 1998.

Stephen Targonski and David Pozar, "Design of Wideband Circularly Polarized Aperture-Coupled Microstrip Antennas," IEEE Transactions on Antennas and Propagation, vol. 41, No. 2, Feb. 1993.

Arun Bhattacharyya, "Comparison Between Arrays of Rotating Linearly Polarized Elements and Circularly Polarized Elements," IEEE Transactions on Antennas and Propagation, vol. 56, No. 9, Sep. 2008.

Jung-Kyu Lee, Chi-Hyung Ahn, and Kai Chang, "Broadband Circularly Polarized Aperture-Coupled Microstrip Antenna with Dual-Offset Feedlines," 2011 IEEE International Symposium on Antennas and Propagation (APSURSI), Jul. 2011.

F. Rostan and W. Wiesbeck, "Design Considerations for Dual Polarized Aperture-Coupled Microstrip Patch Antennas," Antennas and Propagation Society International Symposium, 1995. AP-S Digest, vol. 4, No., pp. 2086-2089 vol. 4, Jun. 18-23, 1995.

Haskins, P.M.; Dahele, S.S.; , "Active polarization-agile microstrip antennas," Antennas and Propagation Society International Symposium, 1997. IEEE., 1997 Digest , vol. 1, No., pp. 10-13 vol. 1, Jul. 13-18, 1997.

Haskins, P.M.; Dahele, J.S.; , "The ellipticity of radiation from polarization-agile patch antennas," Antennas and Propagation, 1999. IEE National Conference on. , vol., No., pp. 256-258, Apr. 1, 1999-Mar. 31, 1999.

Montisci, G.; Mazzarella, G.; Musa, M.; , "A polarization-agile waveguide slot antenna," Antennas and Propagation Society International Symposium, 2003. IEEE , vol. 3, No., pp. 1034-1037 vol. 3, Jun. 22-27, 2003.

Shun-Shi Zhong; Xue-Xia Yang; Shi-Chang Gao; , "Polarization-agile microstrip antenna array using a single phase-shift circuit," Antennas and Propagation, IEEE Transactions on , vol. 52, No. 1, pp. 84-87, Jan. 2004.

Shih-Chieh Yen; Tah-Hsiung Chu; , "A beam-scanning and polarization-agile antenna array using mutually coupled oscillating doublers," Antennas and Propagation, IEEE Transactions on , vol. 53, No. 12, pp. 4051-4057, Dec. 2005.

Vallecchi, A.; , "Wideband Polarization-Agile Planar Microstrip Patch Array Antenna," Antennas and Propagation Society International Symposium 2006, IEEE , vol., No., pp. 4289-4292, Jul. 9-14, 2006.

Jianzhong Zhao; Xiaoxiang He; , "Dual Polarized Microstrip Antenna Array in Polarization-Agile System," Antennas, Propagation & EM Theory, 2006. ISAPE '06. 7th International Symposium on , vol., No., pp. 1-3, Oct. 26-29, 2006.

Simeoni, M.; Lager, I.E.; Coman, C.I.;. , "Interleaving sparse arrays: a new way to polarization-agile array antennas?," Antennas and Propagation Society International Symposium, 2007 IEEE , vol., No., pp. 3145-3148, Jun. 9-15, 2007.

Ferrero, F.; Luxey, C.; Staraj, R.; Jacquemod, G.; Yedlin, M.; Fusco, V.; , "A Novel Quad-Polarization Agile Patch Antenna," Antennas and Propagation, IEEE Transactions on , vol. 57, No. 5, pp. 1563-1567, May 2009.

Vazquez, C.; Ver Hoeye, S.; Fernandez, M.; Leon, G.; Herran, L.F.; Las Heras, F.; , "Receiving Polarization Agile Active Antenna Based on Injection Locked Harmonic Self Oscillating Mixers," Antennas and Propagation, IEEE Transactions on , vol. 58, No. 3, pp. 683-689, Mar. 2010.

* cited by examiner

700

800

900

1000

1100

WIDEBAND PLANAR RECONFIGURABLE POLARIZATION ANTENNA ARRAY

FEDERALLY-SPONSORED RESEARCH AND DEVELOPMENT

The Wideband Planar Reconfigurable Polarization Antenna Array is assigned to the United States Government and is available for licensing for commercial purposes. Licensing and technical inquiries may be directed to the Office of Research and Technical Applications, Space and Naval Warfare Systems Center, Pacific, Code 72120, San Diego, Calif., 92152; voice (619) 553-5118; email ssc_pac_T2@navy.mil; reference Navy Case Number 101783.

BACKGROUND

A need exists for an antenna that provides wideband transmission and reception at radio frequencies that can be electronically reconfigured among four different polarizations: vertical linear polarization (VLP), horizontal linear polarization (HLP), right hand circular polarization (RHCP), and left hand circular polarization (LHCP), in a compact, planar form factor.

DETAILED DESCRIPTION OF SOME EMBODIMENTS

Figure 2:
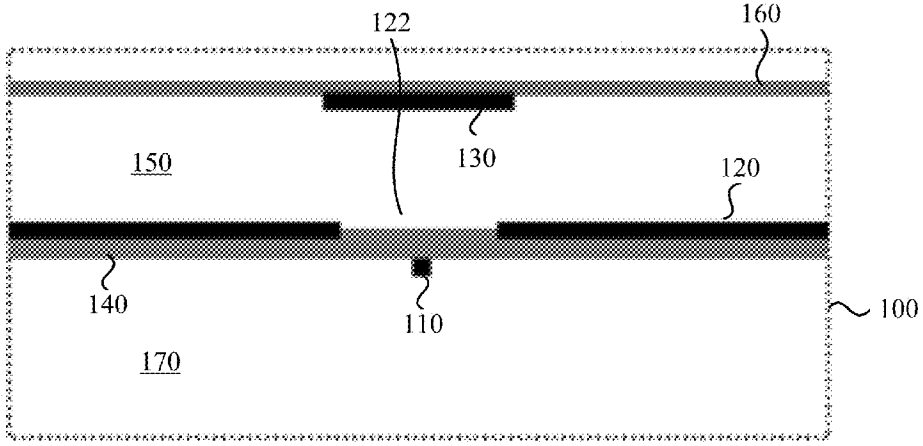
FIG. 2 shows a cross-section view of an embodiment of a single slot microstrip patch antenna element having a single feed line.

The embodiments of the invention disclosed herein involve a planar antenna capable of electronic reconfiguration of its polarization, wide bandwidth (for gain, impedance matching, and axial ratio), and electronically steerable high gain/narrow beamwidth. The embodiments of the invention build from several components: a wideband planar antenna element with a single feed, a wideband planar antenna element with two orthogonal feeds, a sub-array composed of two-feed antenna elements, a full array composed of multiple sub-arrays, the electronic switch circuitry to switch polarizations, and a beamforming device.

Typically, a given RF transmission/reception has a predetermined, fixed polarization. Choice of polarization may be due to necessity or convenience. For example, vertically oriented (and polarized) dipole and monopole antennas are commonly used on vehicles because of their smaller footprint compared to horizontally oriented (and polarized) antennas. For some frequency bands of satellite communications, circular polarization is used to avoid potential polarization mismatch losses caused by variable Faraday rotation through the ionosphere. There is a small set of applications that uses two orthogonally polarized signals, such as more sophisticated types of RADAR.

However, if polarization can be quickly and easily reconfigured on an antenna, it may be used as a dimension for improving wireless communications and networks. For example, a polarization hopping scheme, similar to frequency hopping, can be used to create more covert communications. Additionally, a wireless network with several nodes can segregate its users onto two orthogonal polarizations, thereby halving the number of nodes on each "polarization channel" and drastically reducing the throughput and latency effects of interference.

To yield the greatest benefits to wireless communications and networks, the reconfigurable polarization antenna should be able to electronically change polarizations and support a wide bandwidth. Electronic reconfiguration is needed to ensure that polarization changes can happen at "network time." In the example of a wireless network segregated over two orthogonal polarizations, a node on one polarization may need to communicate on a per-packet basis with two other nodes, one in the same polarization (co-polarized) and the other in the orthogonal polarization (cross-polarized). Network time scales tend to be in microseconds, so the ability to change polarizations needs to happen at the same or a shorter timescale.

Wide bandwidth operation is needed to allow the greatest flexibility to the wireless communications system. Modern, high data rate radios employ fairly large bandwidth channels and can operate over a large range of channels; for example, 802.11a WiFi can occupy a 20 MHz channel within 5180 to 5825 MHz in the U.S. For maximum utility, the use of a reconfigurable polarization antenna should not preclude the use of any of the frequencies available to the given radio and so should be as wide bandwidth as appropriate to the radio (12% in the 802.11a U.S. example).

Another key feature for a reconfigurable polarization antenna is cross-polarization rejection. To truly act covert or reduce co-channel interference, the difference in signal levels between two orthogonal polarizations should be as high as possible. One-hundred fold (or 20 dB) is a good threshold target for cross-polarization rejection. By comparison, in the wireless network segregation example, the spectral mask for 802.11 has the channel band edges at 20 dB below the peak. Another desirable feature is for the antenna to have a small, lightweight form factor. Finally the antenna should be easily arrayed to produce the desired amount of gain and be able to beam steer so the antenna's functionality is not limited to one angle.

Figure 1:
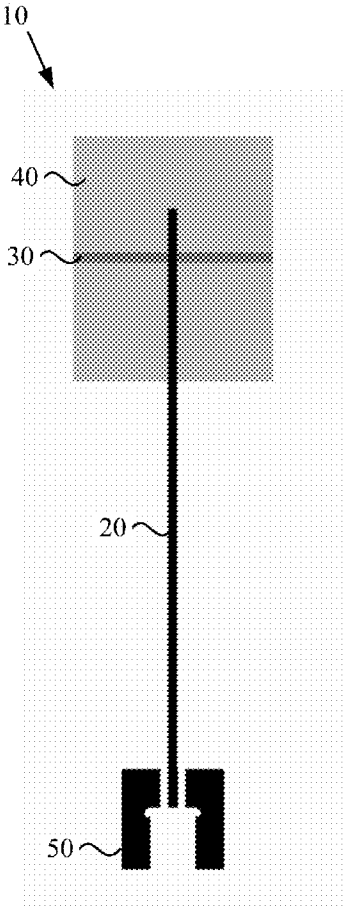
FIG. 1 shows a top view of an embodiment of a single slot microstrip patch antenna element having a single feed line.

FIG. 1 shows a diagram of a top view of an embodiment 10 of a single slot microstrip patch antenna element having a single feed line. The element includes of a microstrip feed line 20 which lies on top of a ground plane, a slot (or aperture) 30 in the ground plane, which allows coupling to the patch 40. The input to the antenna element is a single feed 50.

FIG. 2 shows a cross-section view of an embodiment of a single slot microstrip patch antenna element 100 having a single feed line 110. Antenna element 100 includes ground plane 120 with a slot 122, and a patch 130. Microstrip feed line 110 is situated on a circuit board 140, which has a typical dielectric constant ranging from 2 to 11.6. By using foam as an approximation to air for the patch substrate 150, the antenna element can have large gain and impedance bandwidths. Patch 130 is implemented as the bottom layer of circuit board 160, which has a typical dielectric constant ranging from 2 to 11.6, which also acts as a protective radome for antenna element 100. Microstrip feed line 110 is separated by an airgap 170 from any other circuitry for proper operation.

Figure 3:
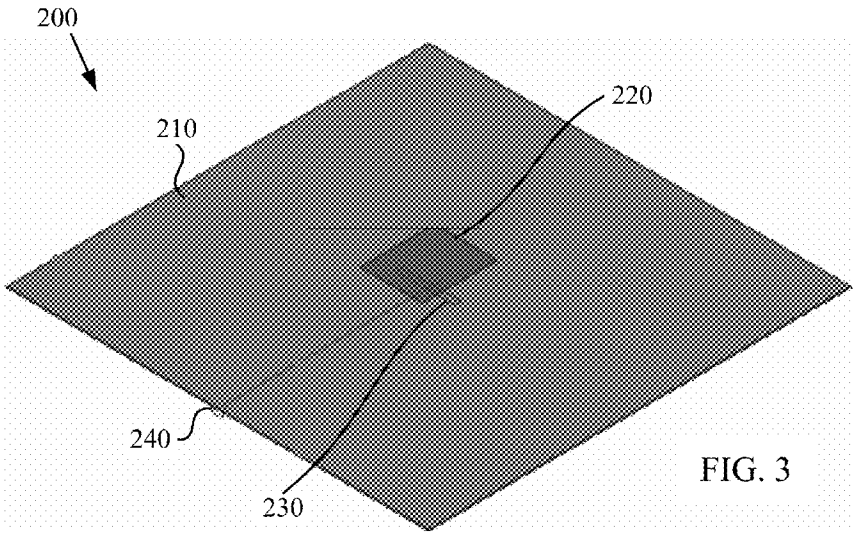
FIG. 3 shows an isometric view of an embodiment of a microstrip patch antenna element having a single feed line.

FIG. 3 shows an isometric view of an embodiment of a microstrip patch antenna element 200 having a single feed line, including a ground plane 210, a microstrip patch 220, a slot 230, and a feed line 240 positioned below ground plane 210.

Figure 4:
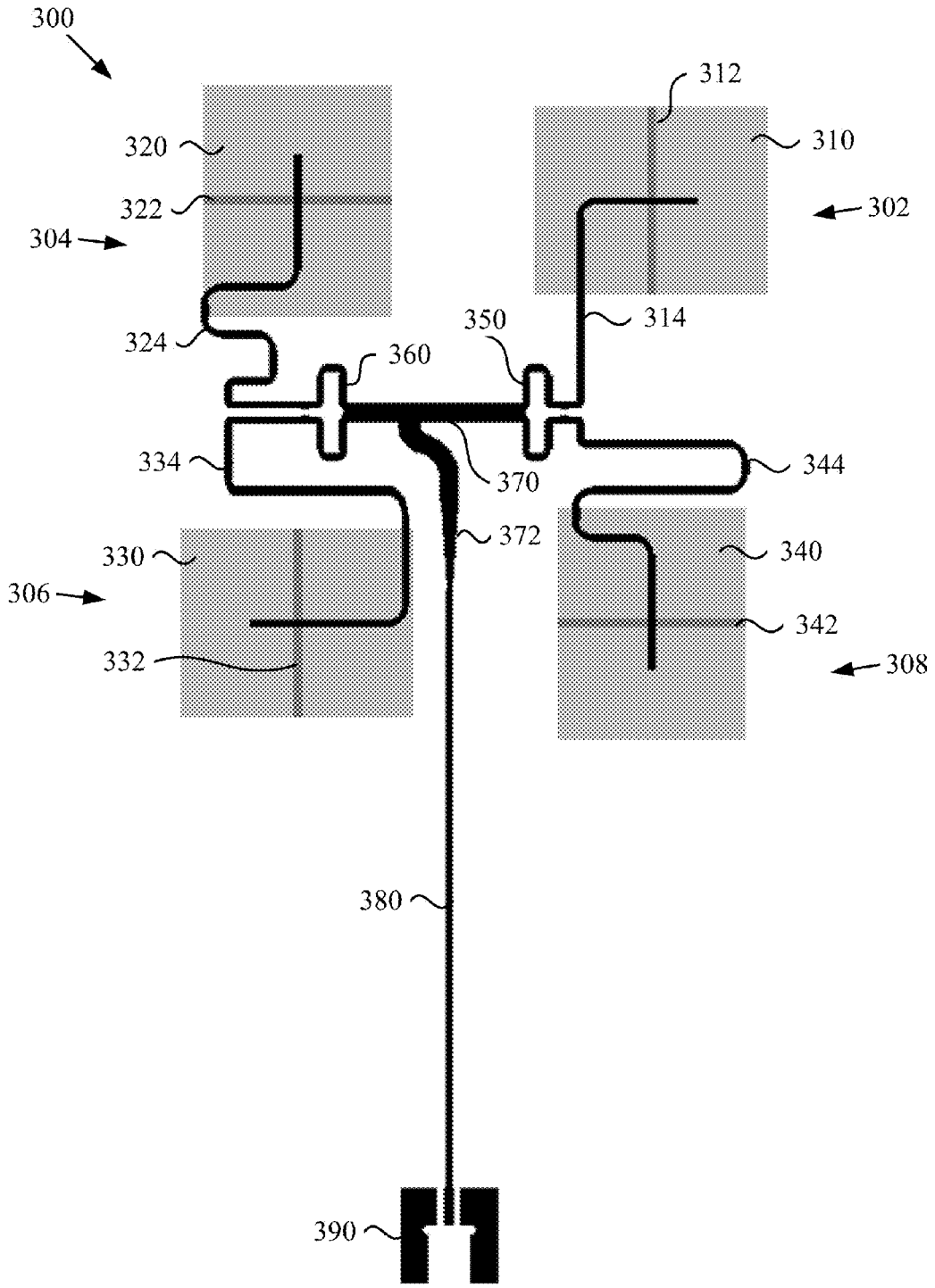
FIG. 4 shows a top view of an embodiment of a 2×2 sub-array of four single-fed, single-slot coupled microstrip patch antenna elements with a single feed line.

FIG. 4 shows a top view of an embodiment of a 2×2 sub-array 300 of four single-fed, single-slot coupled microstrip patch antenna elements 302, 304, 306, and 308 with a single feed line 380. Similarly to the element shown in FIG. 1, element 302 includes a patch 310, a slot 312, and a feed line 314, element 304 includes a patch 320, a slot 322, and a feed line 324, element 306 includes a patch 330, a slot 332, and a feed line 334, and element 308 includes a patch 340, a slot 342, and a feed line 344. Each of elements 302, 304, 306, and 308 are progressively rotated 90°. Antenna element 302 is designated as having 0° rotation and it is fed with 0° additional phase. Then, antenna element 304 is rotated 90° counter-clockwise relative to element 302 and is fed with 90° additional phase, which is generated from additional length of microstrip feed line 324 compared to feed line 314. Similarly, elements 306 and 308 are rotated 180° and 270° counter-clockwise with respect to element 302 and have additional microstrip feed line lengths totaling 180° and 270° additional phase at the center frequency, respectively.

Elements 302, 304, 306, and 308 are combined in stages. First, the elements are combined into pairs using, for example, Wilkinson power combiners 350 and 360. The use of a Wilkinson combiner versus a simple T-junction yields greater isolation between the two elements that are combined. The two pairs are then combined with T-junction 370 for simplicity; however a Wilkinson divider may also be used. An impedance taper 372 brings the characteristic impedance of the feed line 380 back up to the standard 50Ω. The sub-array is then fed with a single input 390.

Figure 5:
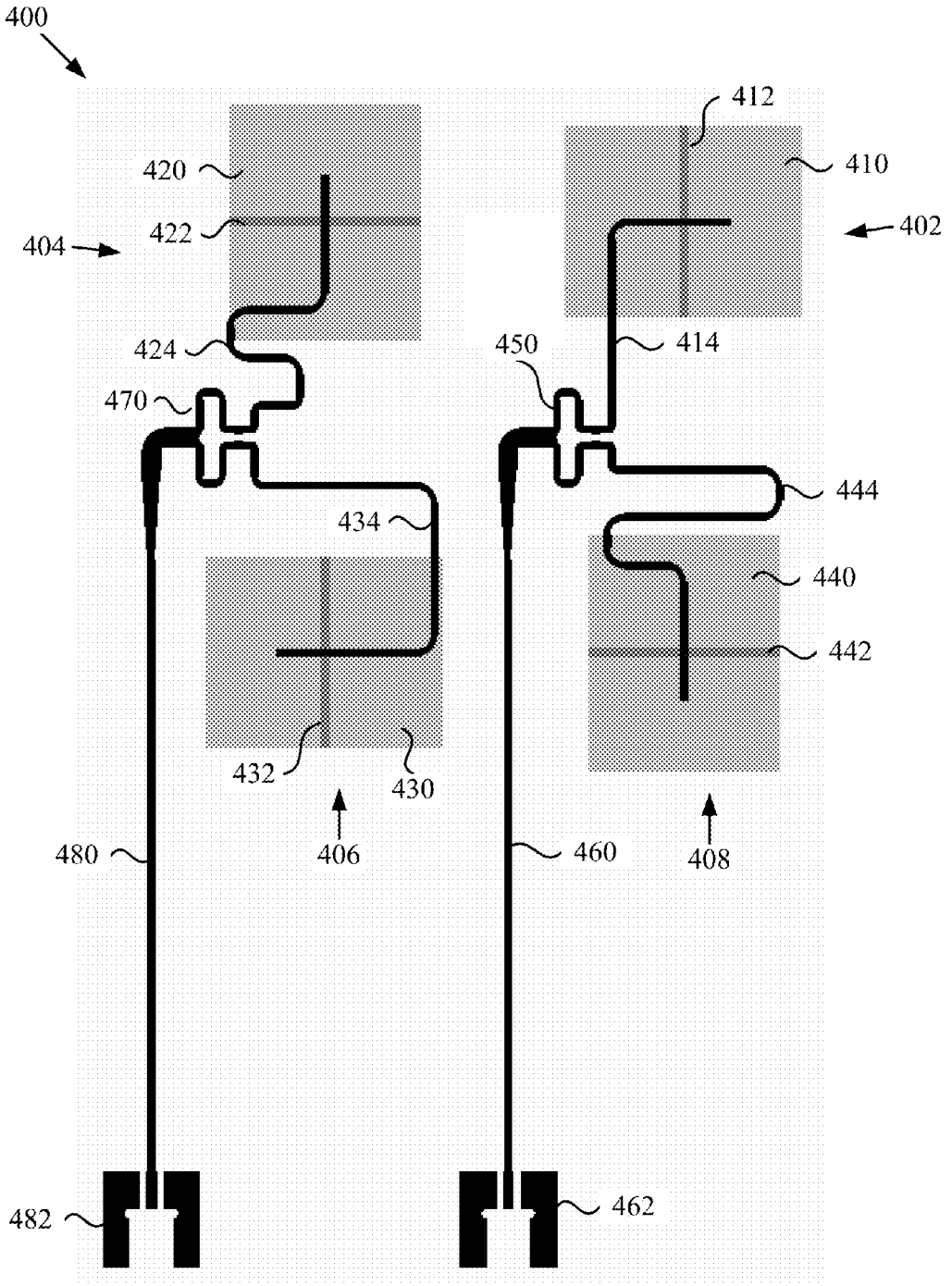
FIG. 5 shows a top view of an embodiment of a 2×2 sub-array of four single-fed, single-slot coupled microstrip patch antenna elements with two feed lines.

FIG. 5 shows a top view of an embodiment of a 2×2 sub-array of four single-fed, single-slot coupled microstrip patch antenna elements 402, 404, 406, and 408 with two feed lines 460 and 480. In some embodiments, the inter-element spacing of elements 402, 404, 406, and 408 is roughly a half wavelength at the highest frequency. Similarly to the element shown in FIG. 1, element 402 includes a patch 410, a slot 412, and a feed line 414, element 404 includes a patch 420, a slot 422, and a feed line 424, element 406 includes a patch 430, a slot 432, and a feed line 434, and element 408 includes a patch 440, a slot 442, and a feed line 444. Each element is progressively rotated 90° and fed with an increasingly longer feed line 414, 424, 434, and 444.

As shown, the feed lines for two pairs of elements, one pair being a column of elements 410 and 440 and the other pair being a column of elements 420 and 430, are joined by a Wilkinson power combiner 450 and 470, respectively. It should be noted however that in other embodiments, each row of elements, as opposed to each column of elements, within the sub-array may be fed by a separate feed line. The feed lines for these two pairs of elements are not further combined to a single feed. Instead, each pair of elements is fed separately by either feed 462 or feed 482. By phasing between feeds 462 and 482, the sub-array can support beam steering.

Figure 6:
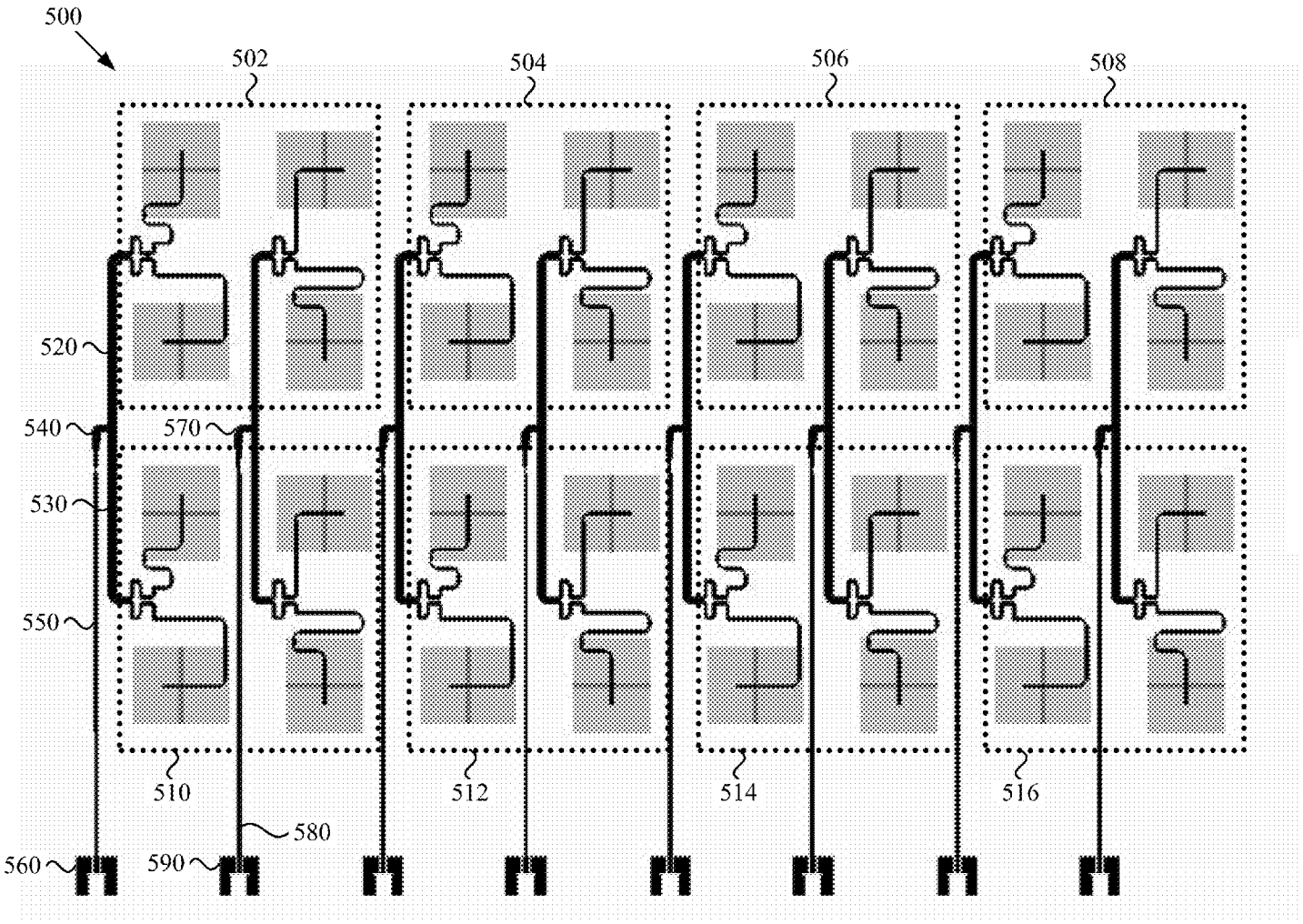
FIG. 6 shows a top view of a 2×4 array of sub-arrays each having four single-fed, single-slot coupled microstrip patch antenna elements with two feed lines.

FIG. 6 shows a top view of a 2×4 array 500 of sub-arrays each having four single-fed, single-slot coupled microstrip patch antenna elements with two feed lines. Array 500 includes sub-arrays 502, 504, 506, 508, 510, 512, 514, and 516. At least two separate lines of array 500 are fed by separate feed lines. For example, similar to the columnar feed configuration as shown in FIG. 5, each column of elements within array 500 is fed by a separate feed line, such as feed lines 550 and 580. It should be noted however that in other embodiments, each row of elements, as opposed to each column of elements, within array 500 may be fed by a separate feed line.

In contrast with the sub-array shown in FIG. 5 however, the column of elements in one sub-array of array 500 is joined by a T-junction combiner to a column of elements in another sub-array in the vertical direction to create a column of array 500. For example, a first sub-array feed line 520, connected by two separate sub-feed lines to the left column of elements of sub-array 502, is joined by combiner 540 to a first sub-array feed line 530 connected, by two separate sub-feed lines to the left column of elements of sub-array 510, forming one column of elements of array 500 that is fed by array feed line 550, which is connected to feed 560. Further, a second sub-array feed line connected, by two separate sub-feed lines to the right column of elements of sub-array 502, is joined by a combiner 570 to a second sub-array feed line connected, by two separate sub-feed lines to the right column of elements of sub-array 510, forming a second column of elements of array 500 that is fed by array feed line 580, which is connected to feed 590. As shown, array feed line 550 and array feed line 580 are not connected.

The use of T-junction and Wilkinson power combiners/dividers in the vertical direction creates a "corporate" feed network for the elements arrayed vertically. However, the different amounts of additional phase that feed each element would make such a vertical linear array not work on its own. Rather, two vertical linear sub-arrays should be used in conjunction to produce a composite circularly polarized phased array (e.g. a column in array 500) that has greater gain, can beam steer in the horizontal (azimuth) direction, and has a narrower, fixed beam in the vertical (elevation) direction.

The array size is also increased horizontally by adding more of these pairs of vertical linear arrays (e.g. columns to array 500). Thus, this 32-element array, which comprises 8 sub-arrays 502-516, can be fed by eight feeds, such as array feeds 560 and 590, as a linear array that is steerable in azimuth. Note that the array size can be increased in either direction by similar means.

Figure 7:
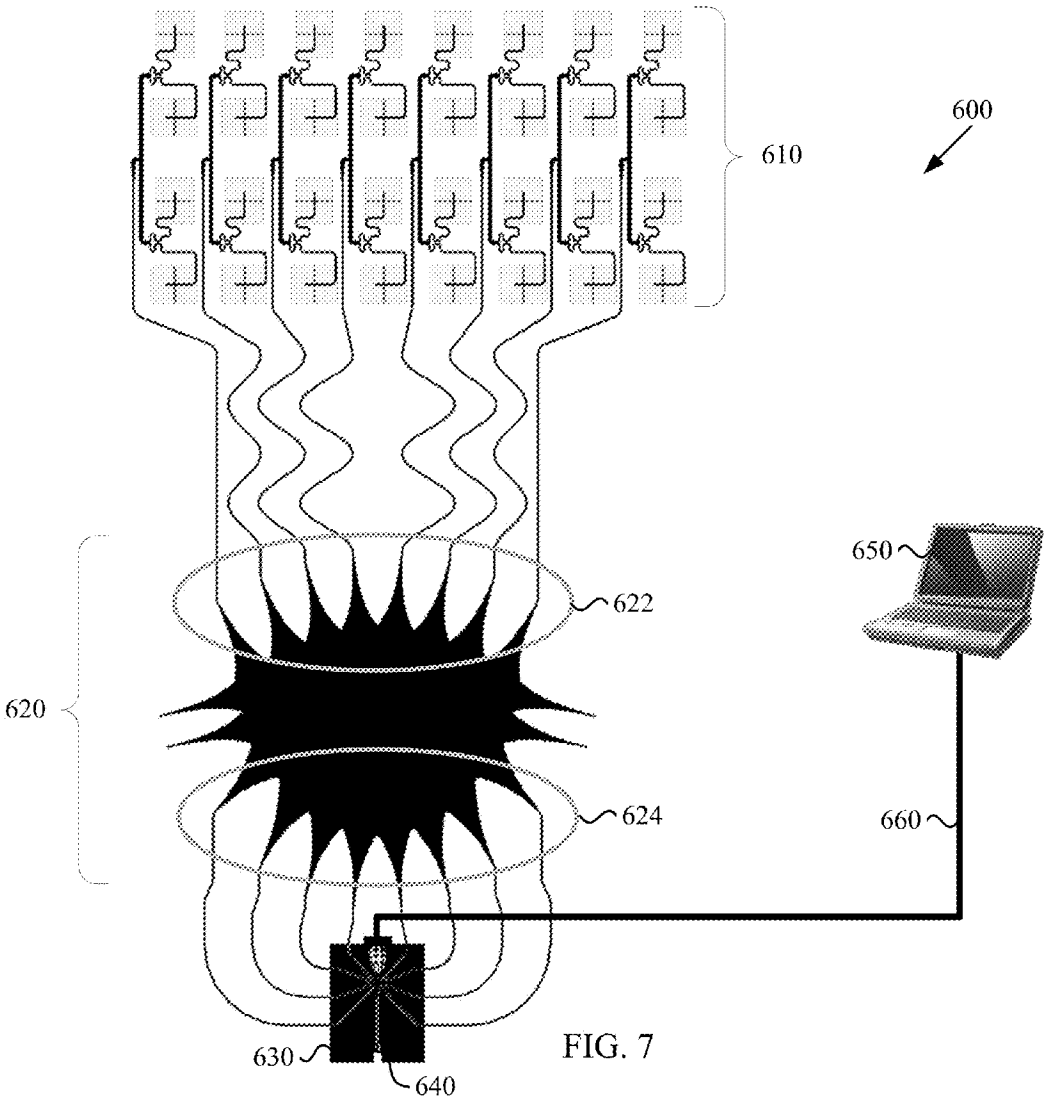
FIG. 7 shows a diagram illustrating an embodiment of a 2×4 array of sub-arrays each having four single-fed, single-slot coupled microstrip patch antenna elements with the two feed lines of each sub-array connected to a Rotman lens beamforming system.

FIG. 7 shows a diagram 600 illustrating an embodiment of a 2×4 array 610 of sub-arrays each having four single-fed, single-slot coupled microstrip patch antenna elements with the two feed lines of each sub-array connected to a Rotman lens beamforming system. Array 610 may be the same as array 500 shown in FIG. 6. The feed lines for array 610 are connected, in this embodiment, to a Rotman lens 620. Rotman lens 620 geometrically establishes phase slopes across its array ports 622 that, when feeding a linear array of antennas, creates a beam steerable in one dimension. Rotman lens 620 may have one or several beam ports 624 that mechanically move across the lens or are switched to various positions on the lens to determine the beam position. The switched version is shown in FIG. 7, with single-pole eight-throw (SP8T) RF switch 630 choosing among the eight beam ports, which correspond to eight options for beam positions. The common port of the RF switch condenses the circularly polarized, beam-steering antenna into a single RF port 640 that may be connected to a SATCOM terminal, line-of-sight radio, or other device (not shown). Control of the beam positions is handled by a computer or microcontroller 650 that sends digital control signals via a wired or wireless connection 660 to RF switch 630.

Figure 8:
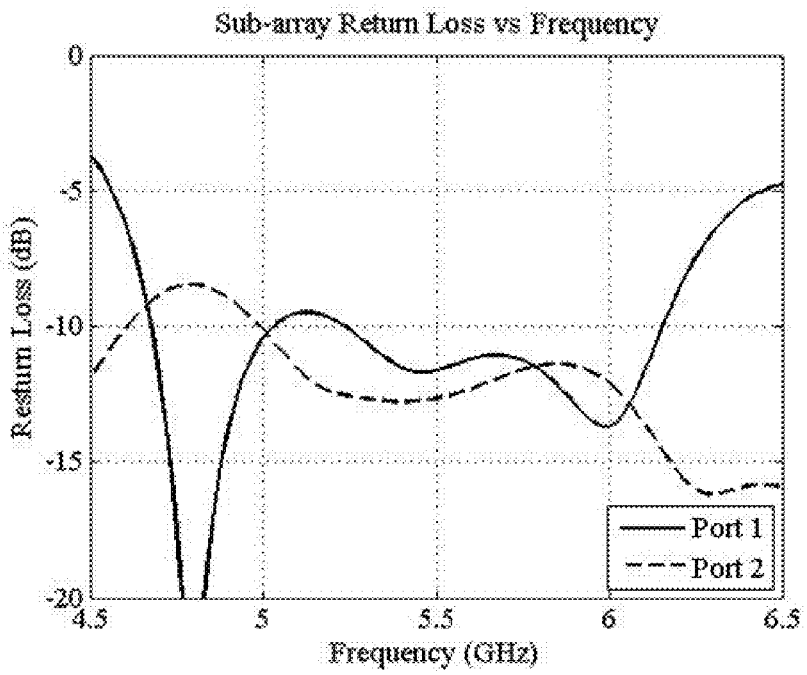
FIG. 8 shows a graph illustrating the simulated input return loss of the two combined feeds for the sub-array shown in FIG. 5.
Figure 9:
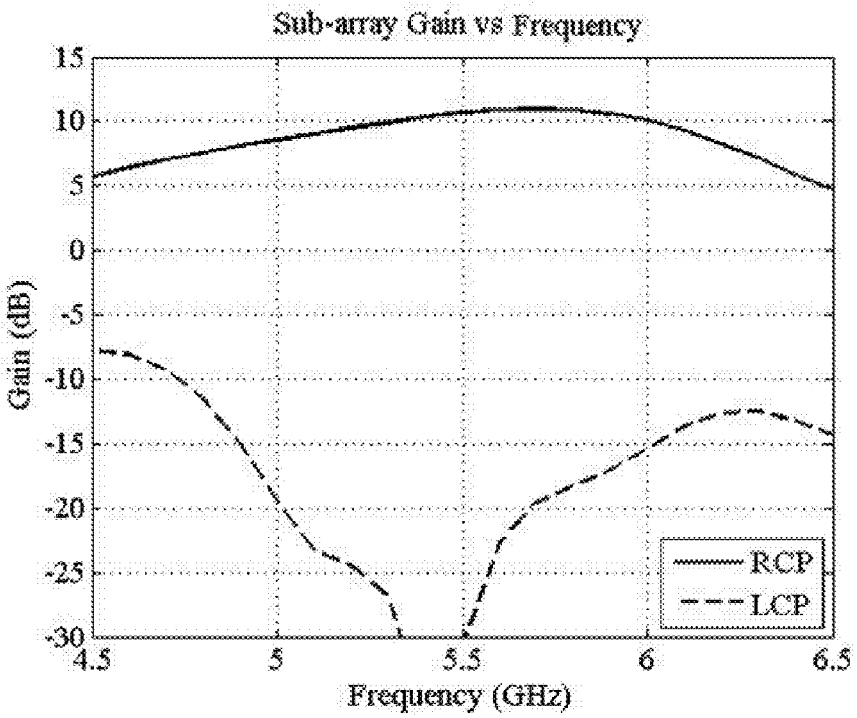
FIG. 9 shows a graph illustrating the broadside co-polarization and cross-polarization gains for the sub-array shown in FIG. 5.
Figure 10:
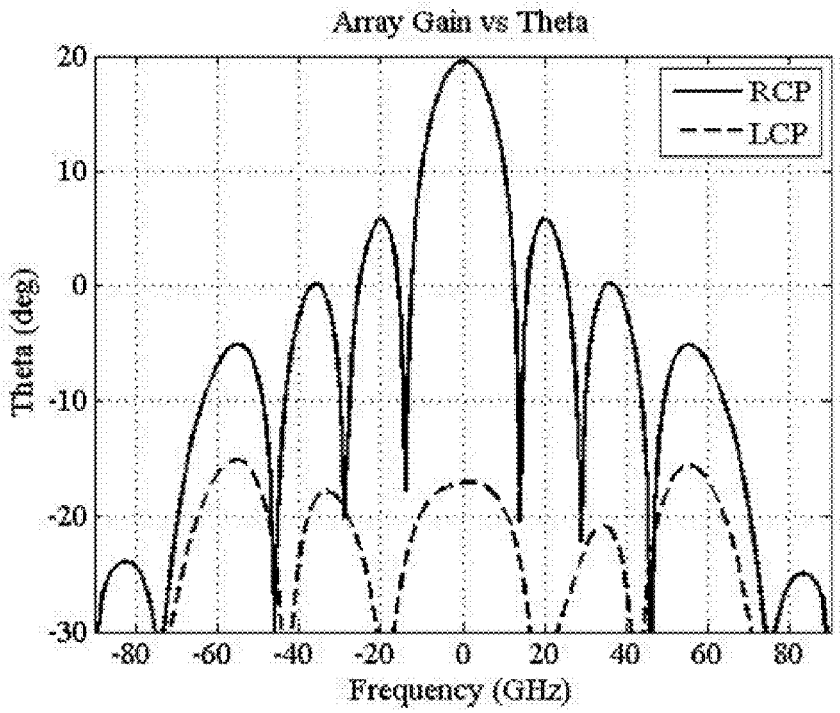
FIG. 10 shows a graph illustrating the co-polarization and cross-polarization beam patterns for the array shown in FIG. 6 without any beam steering.
Figure 11:
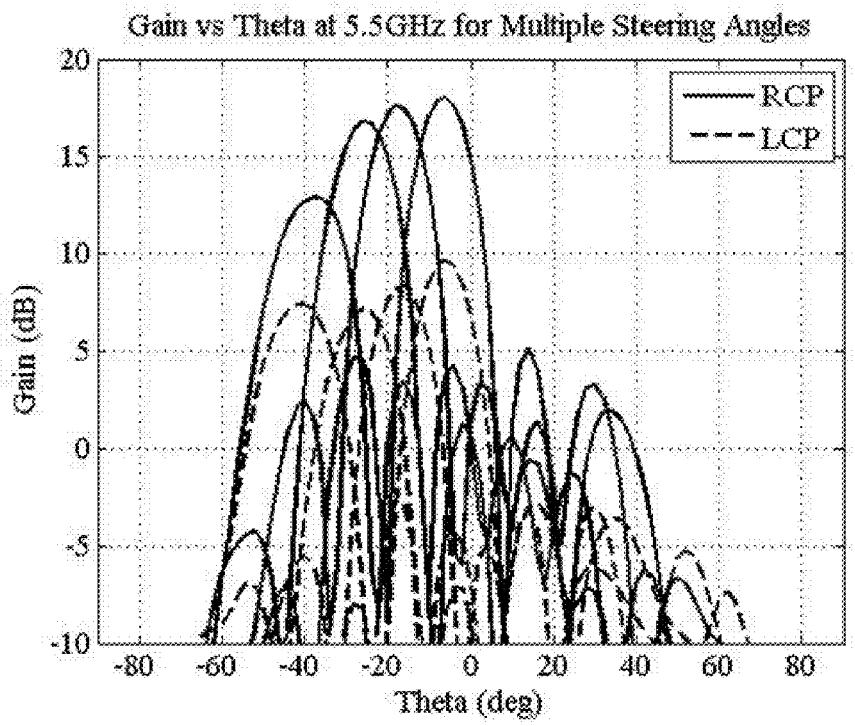
FIG. 11 shows a graph illustrating both co-polarization and cross-polarization beam patterns for the array shown in FIG. 6 driven by phases from a Rotman lens.
Figure 12:
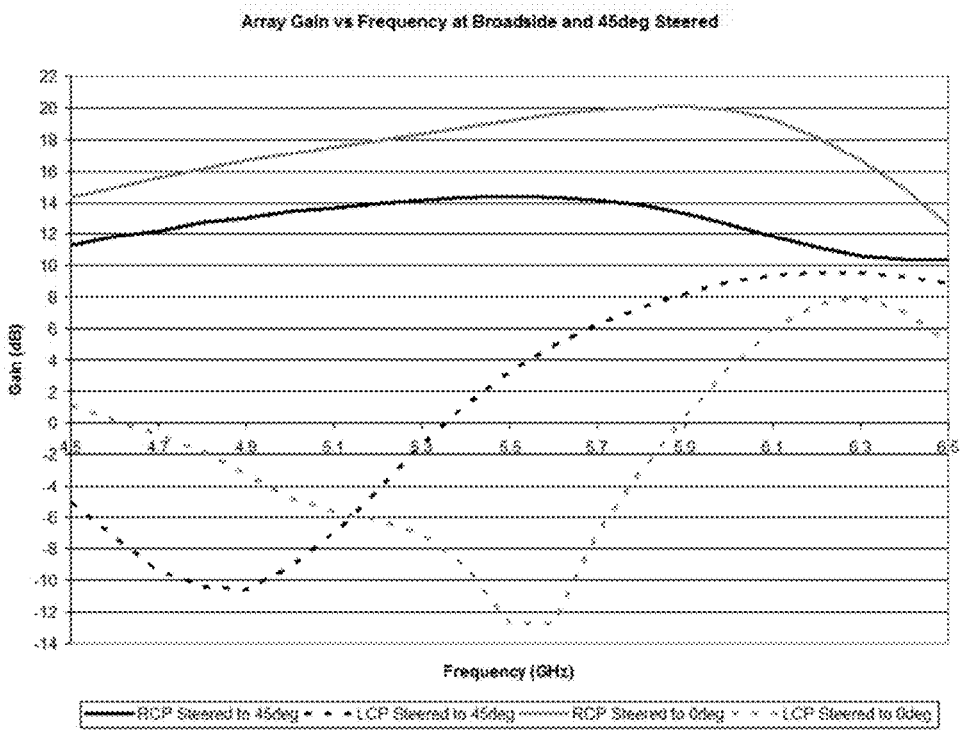
FIG. 12 shows a graph illustrating the gain at broadside and gain steered to 45° for both co-polarization and cross-polarization for the array shown in FIG. 6.

FIG. 8 shows a graph 700 of the simulated input return loss of the two combined feeds for a sub-array with the geometry as depicted in FIG. 5. Graph 700 shows nearly 21% bandwidth for $S_{xx}$<−10 dB. FIG. 9 shows a graph 800 of the broadside co-polarization and cross-polarization gains for the sub-array and demonstrates the high polarization purity over the 5-6 GHz band. FIG. 10 shows a graph 900 of the co-polarization and cross-polarization beam patterns for the array shown in FIG. 6 without any beam steering. FIG. 11 shows a graph 1000 of both co-polarization and cross-polarization beam patterns for the array shown in FIG. 6 driven by phases from a Rotman lens. FIG. 12 shows a graph 1100 of the gain at broadside (not steered) and gain steered to 45° for both co-polarization and cross-polarization for the array shown in FIG. 6. Graph 1100 demonstrates a drawback of the invention when steered to high angles—the polarization purity suffers at high frequencies from the use of the sub-arrays of rotated linear elements.

An advantage of the embodiments of the invention shown in FIGS. 1-7 is the split feeding of a circularly-polarized sub-array of progressively rotated elements to enable beam steering in one dimension. The split feeding allows adjacent pairs of the four elements in a circularly-polarized sub-array to be phased with respect to each other, thereby steering the circularly-polarized beam in one dimension (e.g., azimuth). This technique is expanded to include further power-combining pairs of adjacent circularly-polarized sub-arrays to create a larger, higher gain array capable of concurrent circularly-polarized radiation and beam steering in one dimension.

Another advantage of the embodiments of the invention shown in FIGS. 1-7 is that they enable high performance circular polarization in a compact, lightweight, and low cost form. High performance includes several metrics such as bandwidth, axial ratio, and cross-polarization rejection. Unlike other solutions which utilize inherently narrowband radiating elements, such as dipoles and probe-fed patches, some embodiments of this invention employ aperture-coupled microstrip patch elements which provide suitable wideband characteristics in addition to being planar and of an arrayable size.

Axial ratio and cross-polarization rejection both benefit from the use of a sub-array of progressively rotated elements. The embodiments of the invention shown in FIGS. 1-7 employ single-fed linearly polarized elements. This choice simplifies the feed structure, ensures high cross-polarization rejection at the element level, and offers wider circular polarization bandwidth (axial ratio and cross-polarization rejection) since only the inter-element phasing is frequency dependent. Dual-fed circularly-polarized elements also have inter-feed phasing that, when combined with the inter-element phasing, narrows the performance bandwidth of the sub-array.

The planar nature of the embodiments of the invention shown in FIGS. 1-7 makes it easy to fabricate on low cost printed circuit boards and foam sheets. Such planar implementation is limited in its ability to scan to very large angles (near end-fire) but avoids costly waveguide or other 3D fabrication. High gain in a planar form is achieved by further arraying the circularly-polarized sub-arrays of the embodiments of this invention, which avoids the use of non-planar methods, such as using a reflector.

Further, by using phase shifting at the full array level, a large fraction of the full area of the antenna contributes to gain at all steering angles. This provides much improved gain and narrower beamwidths compared with antennas that dedicate only sections of the full array to each beam position. Such prior antennas are also limited in beam steering resolution (number of beams). There exist mechanical means for beam steering a circularly-polarized array, but these have limitations in steering speed and are prone to higher mechanical failure rates compared with electrical steering.

Additionally, the use of a Rotman lens for creating the phase slope that beam steers in some embodiments of the invention shown in FIGS. 1-7 is advantageous in that it is both wideband and low cost. If conventional modulo-360 degree phase shifters are used to beam steer, they have the limitation that the desired phase is only accurate at the center frequency. For instantaneously wideband RF signals, the beam will exhibit "squint" in that the low frequency portion will be steered differently from the high frequency portion. The true-path phase shifting nature of the Rotman lens ensures that the wideband circularly-polarized signal of the antenna array is also wideband steered. Rotman lens beam steering is also consistent with the low cost nature of the embodiments of the invention shown in FIGS. 1-7 as they can be realized as a printed circuit board, ideally the same printed circuit board as the antenna array feed network.

While some embodiments of the invention shown in FIGS. 1-7 use microstrip-fed, aperture-coupled microstrip patch antennas as the radiating elements, in other embodiments the feed lines may be implemented in stripline, which would allow the array to be stacked on other RF circuitry (e.g., stacking the Rotman lens beamformer under the array feed). In some embodiments, other linearly polarized, wideband radiating elements may be used so long as their dimensions are small enough to allow arraying (dimensions roughly less than one wavelength).

Further, in some embodiments of the invention shown in FIGS. 1-7 the Rotman lens may be replaced by other wideband phasing devices, such as other "constrained" RF lenses (bi-focal, quadrafocal, etc.), 3D lenses (e.g., Luneburg lens), and the Butler matrix.

Figure 13:
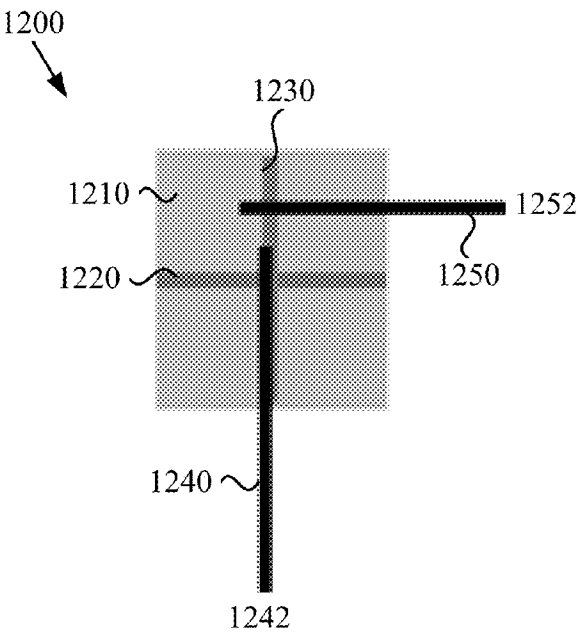
FIG. 13 shows a top view of an embodiment of a cross-slot microstrip patch antenna element having two feed lines.

FIG. 13 shows a top view of an embodiment of a cross-slot microstrip patch antenna element 1200 having two feed lines. Element 1200 includes a patch 1210, a first slot 1220, a second slot 1230, a first feed line 1240 with output port 1242, and a second feed line 1250 with output port 1252. First slot 1220 and second slot 1230 cross to form a cross-slot in the ground plane. First feed line 1240 and second feed line 1250 are orthogonally oriented.

The transmitted/received beam from antenna element 1200 can have any desired polarization by choosing the appropriate magnitude and phase on the two orthogonal feeds. For example, with antenna element 1200 oriented as shown in FIG. 13, setting the input magnitudes on ports 1242 and 1252 to >0 and 0, respectively, will result in vertical linear polarization. If port 1252 has non-zero magnitude while port 1242 is set to 0, the antenna will radiate horizontal linear polarization. Left or right hand circular polarization can be achieved by feeding the two ports with equal magnitudes but with port 1242 +90° or −90° out of phase from port 1252, respectively.

Figure 14:
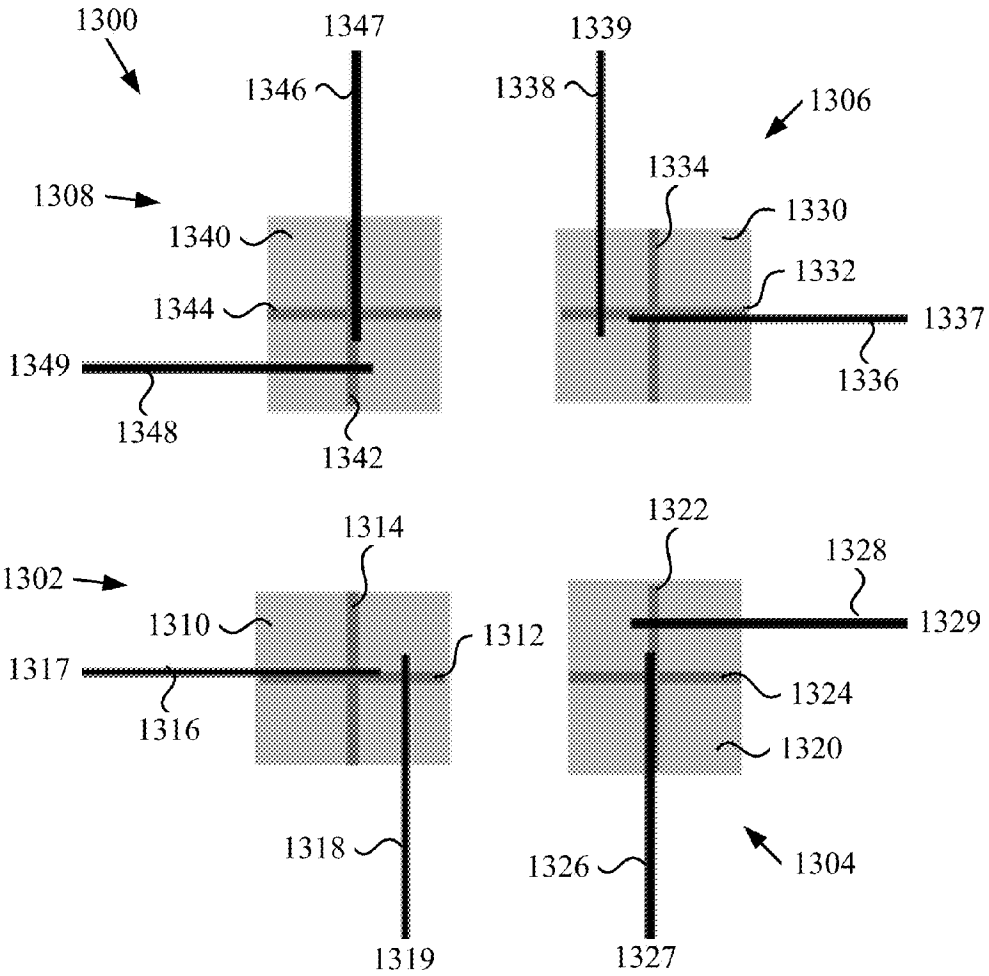
FIG. 14 shows a top view of a 2×2 sub-array of four dual-fed, cross-slot coupled microstrip patch antenna elements.

FIG. 14 shows a top view of a 2×2 sub-array 1300 of four dual-fed, cross-slot coupled microstrip patch antenna elements 1302, 1304, 1306, and 1308. As an example, the inter-element spacing may be roughly a half wavelength at the highest frequency. Element 1302 includes a patch 1310, slots 1312 and 1314, feed line 1316 with output port 1317, and feed line 1318 with output port 1319. Element 1304 includes a patch 1320, slots 1322 and 1324, feed line 1326 with output port 1327, and feed line 1328 with output port 1329. Element 1306 includes a patch 1330, slots 1332 and 1334, feed line 1336 with output port 1337, and feed line 1338 with output port 1339. Element 1308 includes a patch 1340, slots 1342 and 1344, feed line 1346 with output port 1347, and feed line 1348 with output port 1349.

Each patch, slot, and their feeds are progressively rotated 90°. Sub-array 1300 can generate linear polarizations with the following port (phase) combinations. Vertical polarization is created by feeding the ports as follows: 1319 (0°), 1327 (0°), 1339 (180°), and 1347 (180°). Horizontal polarization is created by feeding the ports as follows: 1317 (0°), 1329 (180°), 1337) (180°, and 1349 (0°). Sub-array 1300 can generate circular polarization with a variety of port (phase) combinations. To preserve good axial ratio performance, the elements in sub-array 1300 should use the same feed(s) when generating circular polarization. For example, right hand circular polarization can be generated by feeding the center-fed ports as follows: 1317 (0°), 1327) (90°, 1337 (180°), and 1347 (270°). The same polarization can also be generated by feeding all the offset feeds with the same phase progression or a combination of the two ports on each element, so long as the combination (magnitude and phase) is the same and each element is fed with progressively increasing phase. Left hand circular polarization can likewise be generated with similar feed options, but with progressively decreasing phase.

Figure 15:
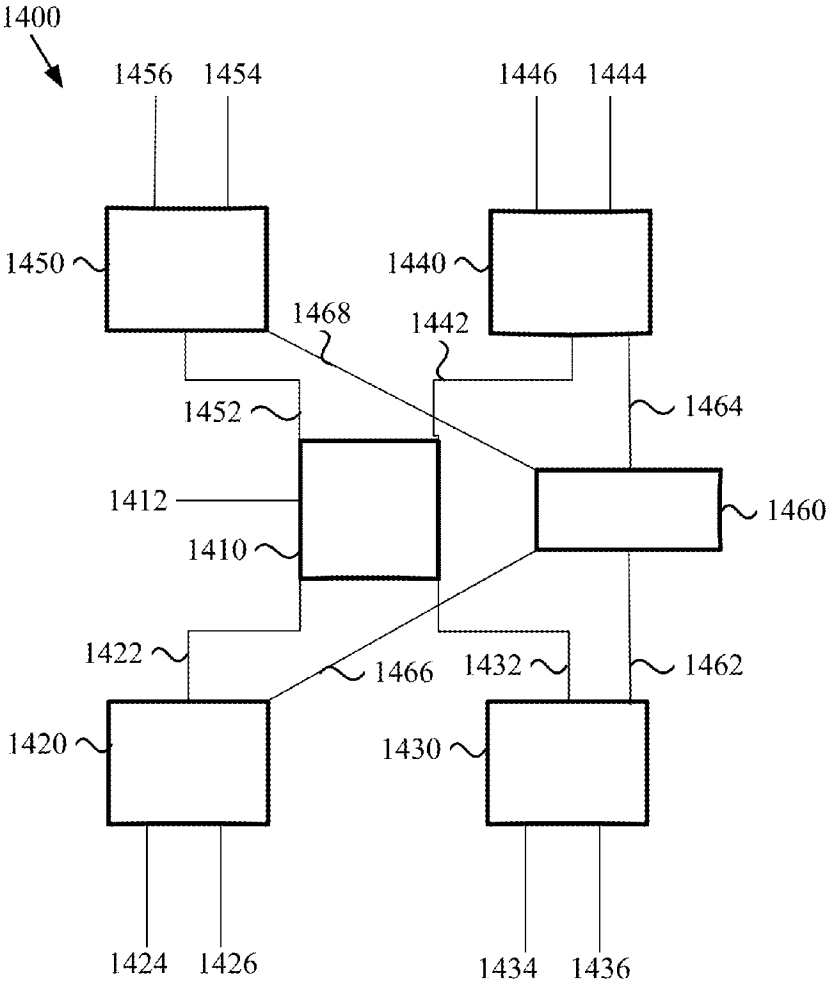
FIG. 15 shows a block diagram of the feed network for the sub-array shown in FIG. 14.

FIG. 15 shows a block diagram of the feed network 1400 for the sub-array shown in FIG. 14. A 1×4 power divider/combiner 1410 is joined to switching/phasing blocks 1420, 1430, 1440, and 1450 via equal path length transmission lines 1422, 1432, 1442, and 1452. The common RF feed port, 1412, is connected to the transmitting and/or receiving device such as a radio or spectrum analyzer (not shown). The output ports 1424 and 1426, 1434 and 1436, 1444 and 1446, and 1454 and 1456 of the switching/phasing blocks 1420, 1430, 1440, and 1450, respectively, are connected to the associated feed ports 1317 and 1319, 1327 and 1329, 1337 and 1339, and 1347 and 1349, on sub-array 1300 shown in FIG. 14. Electronic controller 1460 connects to and controls the switching/phasing blocks via control lines 1462, 1464, 1466, and 1468. In some embodiments, a Wilkinson power divider/combiner is used for power divider/combiner 1410 to ensure high isolation among the elements in the sub-array and preserve high cross-polarization rejection.

Depending on the choice of feed/phase combinations to yield the desired polarizations and which element of the sub-array is being fed, switching/phasing blocks 1420, 1430, 1440, and 1450 can be implemented in a manner of ways. For example, one can designate antenna element 1302 in FIG. 14 to always be fed with 0° relative phase. Then, the switching/phasing block connected to antenna element 1302 (1420 in the FIG. 15 numbering scheme) can be a simple single pole, double throw RF switch.

Figure 16:
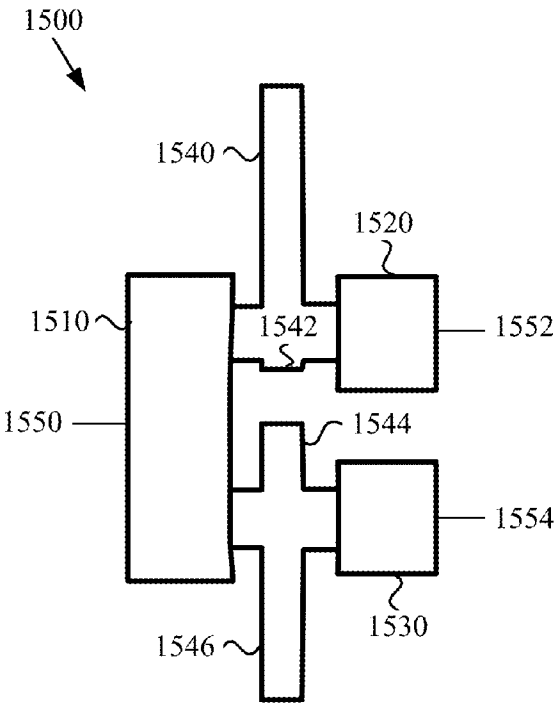
FIG. 16 shows a diagram illustrating an embodiment of a switching/phasing block configuration for an array of dual-fed, cross-slot coupled microstrip patch antenna elements.

FIG. 16 shows a diagram illustrating an embodiment of a switching/phasing block configuration 1500 for an array of dual-fed, cross-slot coupled microstrip patch antenna elements. Configuration 1500 accommodates different phases at the two output ports. A single pole, four throw RF switch 1510 is connected to a pair of single pole, double throw RF switches 1520 and 1530 via different electrical length transmission lines 1540, 1542, 1544, and 1546. Using switching/phasing block 1420 shown in FIG. 15 as an example, the switch/phasing block connects via the common port 1550 (port 1422 in FIG. 15) to power divider/combiner 1410 shown in FIG. 15 and to the antenna element feed ports 1424 and 1426 shown in FIG. 14 via outputs 1552 and 1554.

Figure 17:
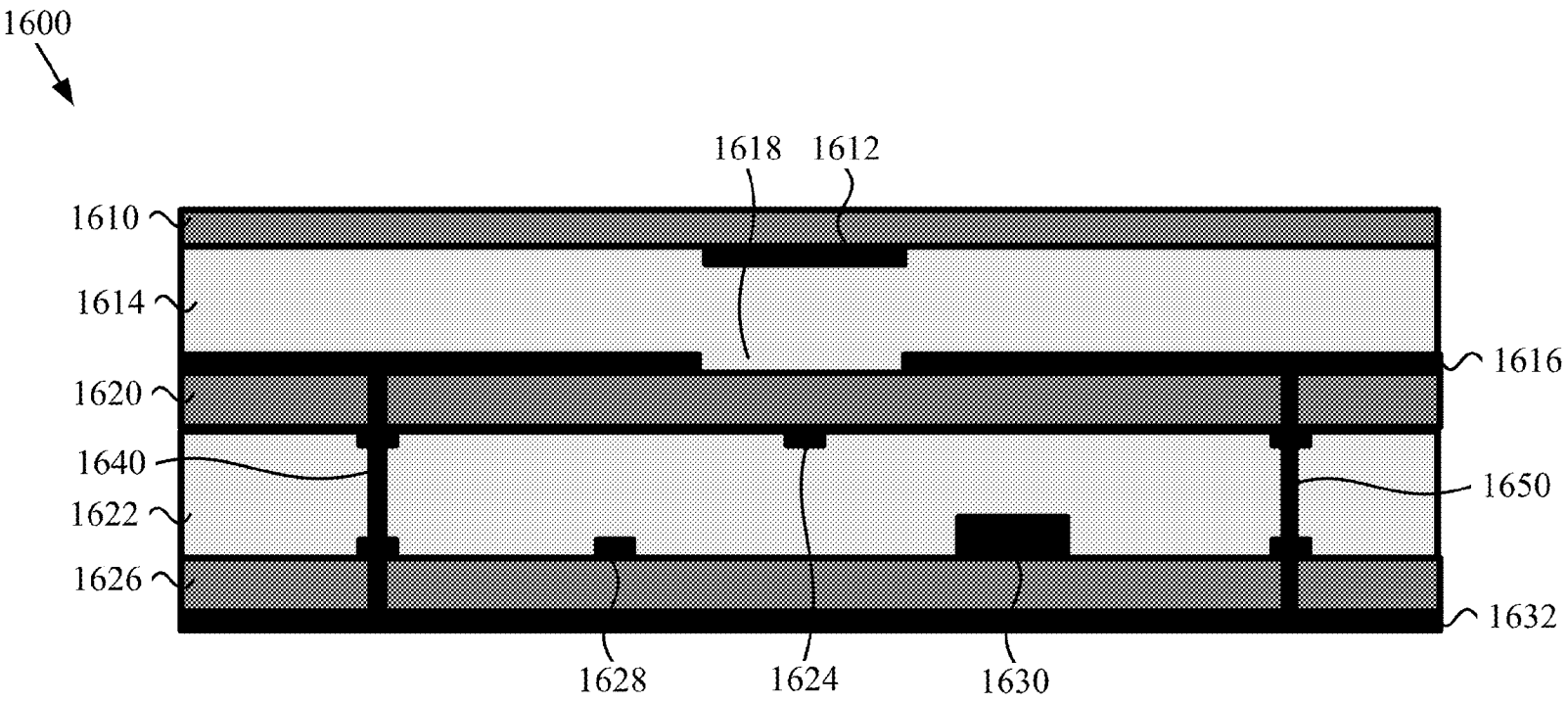
FIG. 17 shows a cross-section view of an embodiment of a cross-slot microstrip patch antenna sub-array and feed/switch/phasing network fabricated in circuit board form.

FIG. 17 shows a cross-section view of an embodiment of a cross-slot microstrip patch antenna sub-array and feed/switch/phasing network 1600 fabricated in circuit board form. The antenna can be made on printed circuit boards with the dielectrics or "cores" being the protective radome 1610, microstrip patch substrate 1614 (typically air/foam for wide bandwidth performance), patch feed substrate 1620, interconnect dielectric 1622 (typically air/foam for ease of manufacture and to reduce fringing fields), and feed network substrate 1626. The patch 1612 is coupled via slot 1618 in ground plane 1616 to the feed transmission line trace 1624. Vertical RF interconnections 1640 and 1650 connect traces between the patch feed and feed network layers. These interconnections could be mating through-hole coaxial connectors, plated through holes, flexible coplanar waveguide, etc. The feed network and switching/phasing transmission lines are depicted by 1628 with potential active and passive components 1630 (e.g., RF switch integrated circuits). The orientation of ground plane 1632 and the feed network traces and components, 1628 and 1630, may be swapped, but as depicted the orientation provides good shielding for the traces and components from outside influences.

Figure 18:
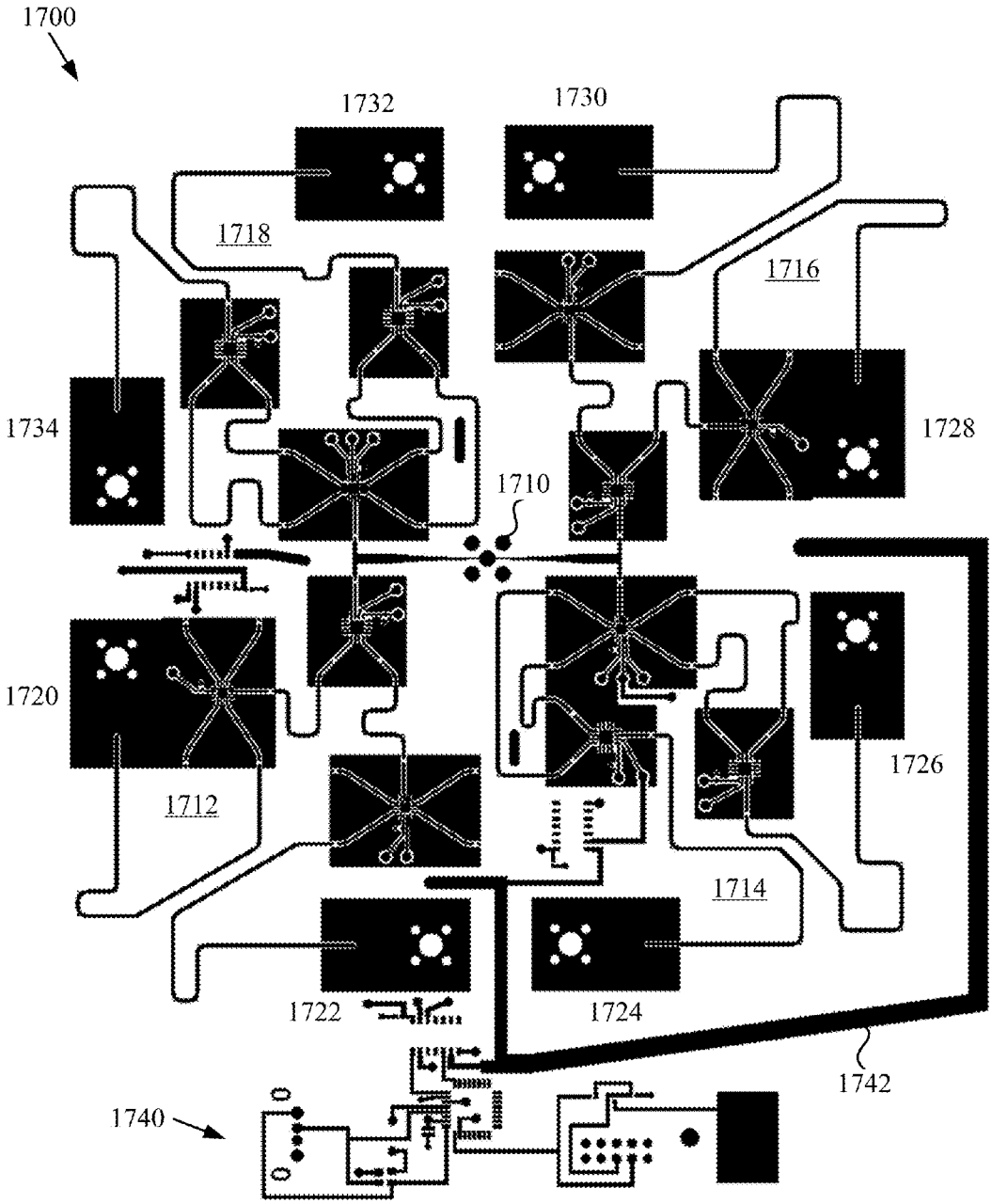
FIG. 18 shows a diagram of the RF and digital circuitry for the feed/switching/phasing network of an embodiment of a 2×2 sub-array of four dual-fed, crossed-slot coupled microstrip patch antenna elements.

FIG. 18 shows a diagram of the RF and digital circuitry 1700 for the feed/switching/phasing network of an embodiment of a 2×2 sub-array of four dual-fed, crossed-slot coupled microstrip patch antenna elements. The common feed 1710 power divides out (in the transmit sense) to switching/phasing blocks 1712, 1714, 1716, and 1718. As an example, these blocks consist of single pole, double throw and single pole, four throw RF switches. The same switches may be used even in cases that do not require all of the switch options (such as 1712 and 1716) to ensure that the split RF signals experience the same magnitude and phase effects on all four elements. The outputs of these switching/phasing blocks —1720 and 1722, 1724 and 1726, 1728 and 1730, and 1732 and 1734— connect to the two feeds of each element in the sub-array, such as sub-array 1300 shown in FIG. 14. In this prototype, the vertical RF transitions between block outputs 1720-1734 and the corresponding ports 1317-1349 of sub-array 1300 shown in FIG. 14 are made with mating through-hole RF connectors. Power and digital control of the switching/phasing blocks are provided by digital and power feeds 1740 and 1742, respectively.

Figure 19:
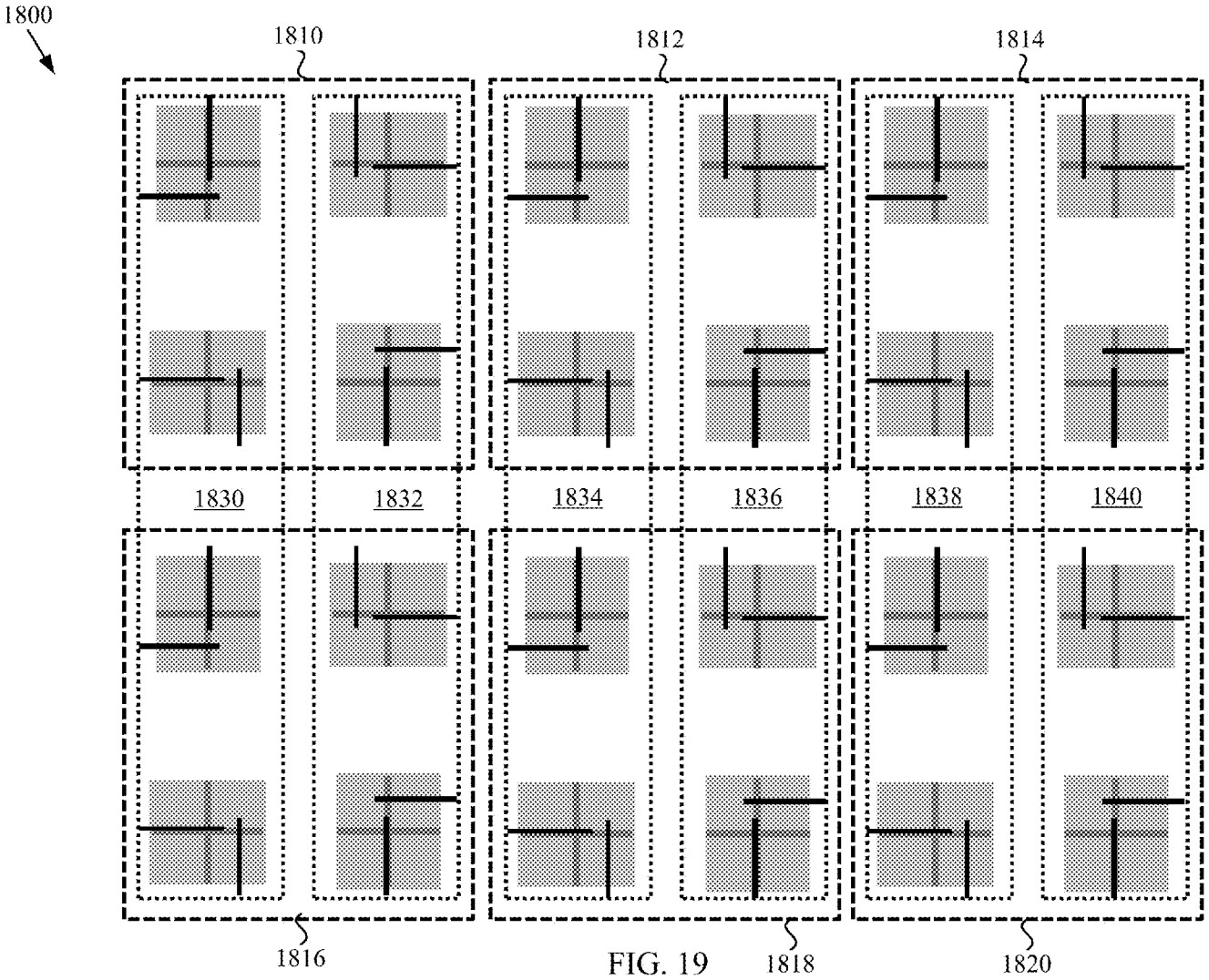
FIG. 19 shows an embodiment of a 2×3 antenna array of a planar electronically reconfigurable sub-arrays as shown in FIG. 14.

FIG. 19 shows an embodiment of a 2×3 antenna array 1800 of a planar electronically reconfigurable sub-arrays 1810, 1812, 1814, 1816, 1818, and 1820 (shown in dashed lines). Each of the sub-arrays may be configured the same as sub-array 1300 shown in FIG. 14. It should be noted that more or fewer sub-arrays may be included within array 1800. The inter-element spacing of the sub-arrays, as with the elements, may be roughly a half wavelength at the highest frequency. In its most general form, array 1800 can be both electronically reconfigured for polarization and phased for two-dimensional steering. This would require each of the elements in the array to be independently phased with one or more of its two feeds active. Such a feed network is extremely complicated.

A simpler version results from limiting the steering to one-dimension, typically steering in azimuth. Accordingly, the polarization-reconfigurable sub-arrays are split in half and elements located in the same column on the array, such as elements in columns 1830, 1832, 1834, 1836, 1838, and 1840 (shown in dotted lines) are combined into a single linear array and are fed with the same phase for steering purposes. However, the sub-array-associated pairs of elements will have different feed/phase configurations depending on the desired polarization.

Figure 20:
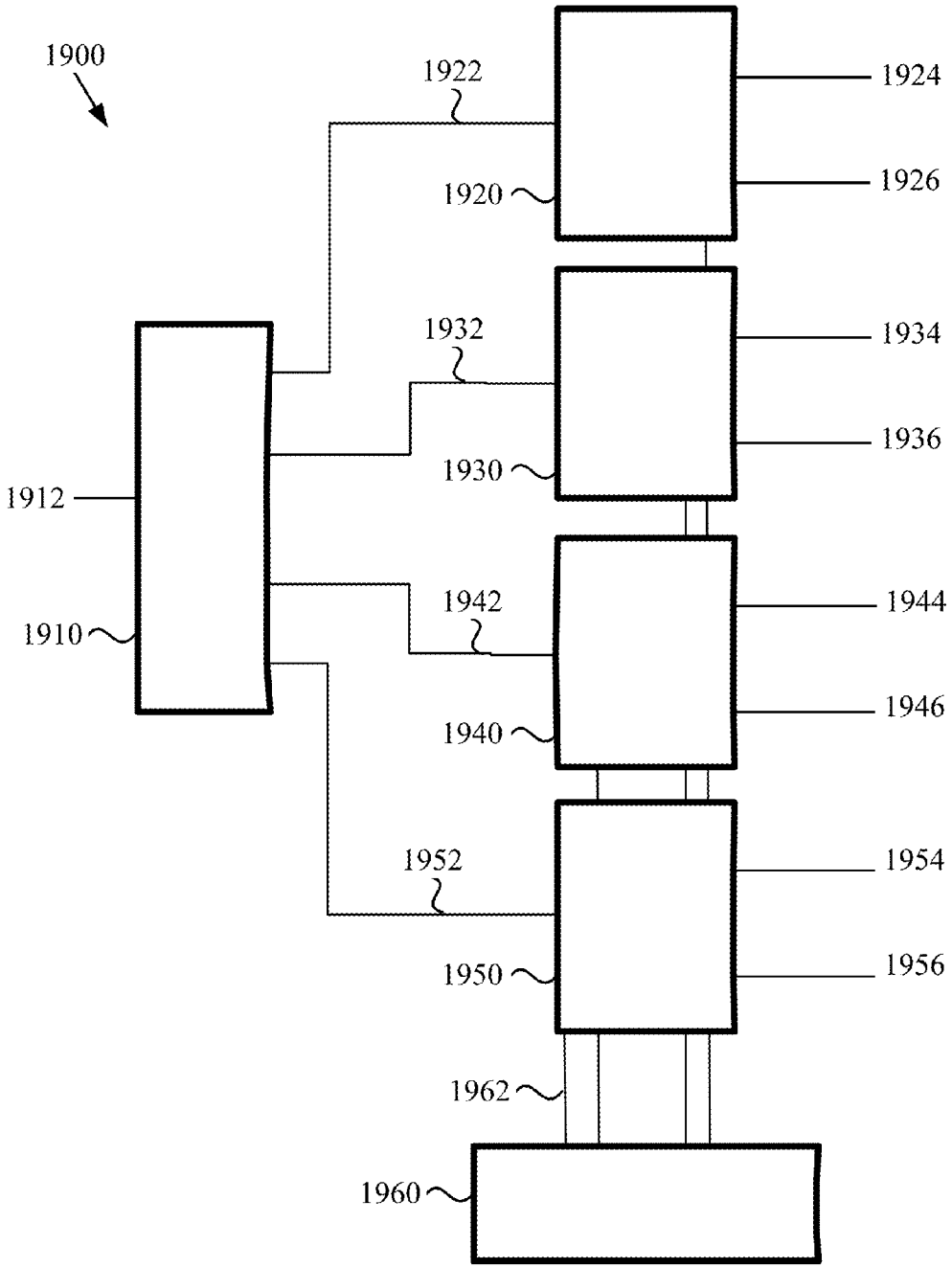
FIG. 20 shows a block diagram of an embodiment of the feed/switch/phase network for a column linear array of the array shown in FIG. 19.

FIG. 20 shows a block diagram of an embodiment of the feed/switch/phase network 1900 for a column linear array of the array shown in FIG. 19. The power divider/combiner 1910 is typically a corporate feed network but can also be a series or sequential feed network. Switching/phasing blocks 1920, 1930, 1940, and 1950 switch among the two feeds of the antenna elements and provide the appropriate phase to each element for the desired polarization. Transmission lines 1922, 1932, 1942, and 1952 connecting power divider/combiner 1910 to switching/phasing blocks 1920, 1930, 1940, and 1950, respectively, are equal length to ensure the elements steer to broadside at the center frequency. A common port 1912 feeds the linear array and outputs 1924 and 1926 of block 1920, outputs 1934 and 1936 of block 1930, outputs 1944 and 1946 of block 1940, and outputs 1954 and 1956 of block 1950 connect to the feeds of the elements in a column of the full array, such as the feeds (not shown) of the elements of columns 1830-1840 of array 1800 shown in FIG. 19.

Switching/phasing blocks 1920, 1930, 1940, and 1950 are controlled electronically by controller 1960 using control lines 1962. It should be noted that FIG. 20 illustrates the block diagram for the feed/switch/phase network of a linear array (column) of the full array shown in FIG. 19, so the number of elements in the column supported is four. However, with larger arrays, this feed/switch/phase network may be expanded to support the required number of elements in a column (e.g., 6, 8, 10, etc.).

Figure 21:
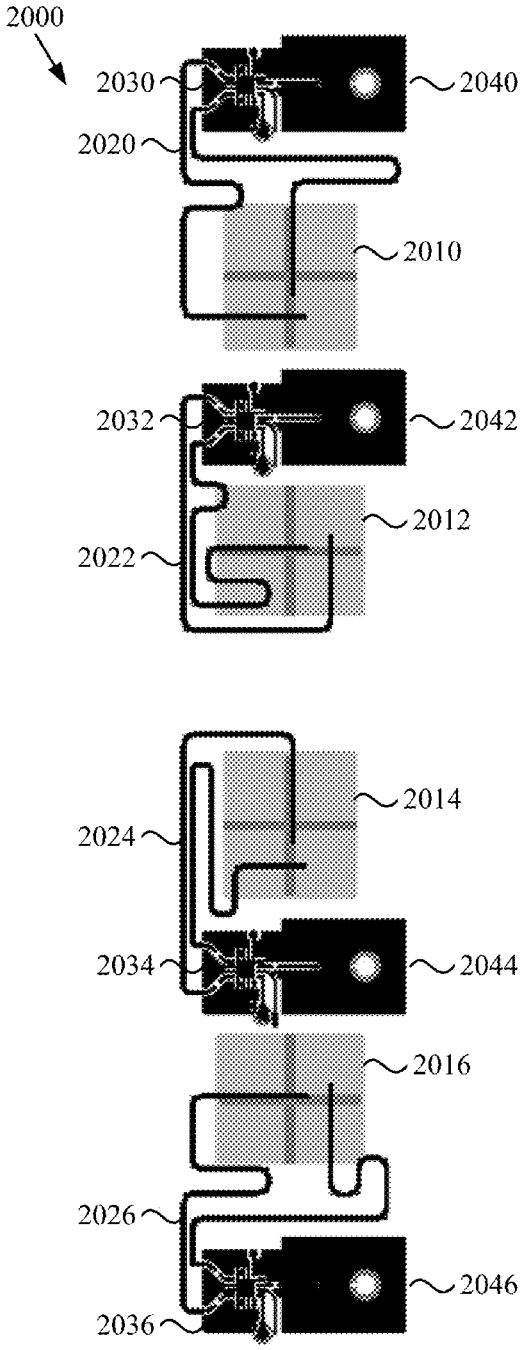
FIGS. 21 and 22 shows diagrams of a prototype of the column linear array and feed/switch/phase network as depicted in FIG. 20.
Figure 22:
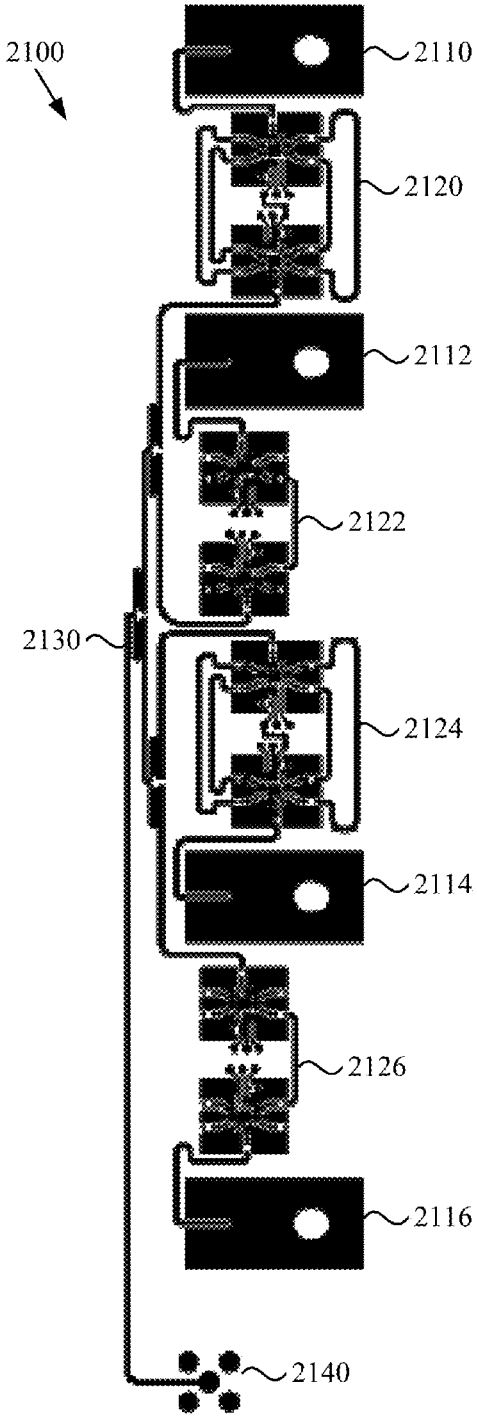

FIGS. 21 and 22 shows diagrams 2000 and 2100 of a prototype of the column linear array and feed/switch/phase network as depicted in FIG. 20. For layout space considerations, the switching/phasing blocks are separated and placed on two layers (such as 1624 and 1628 of FIG. 17). In FIG. 21, the dual-feed antenna elements 2010, 2012, 2014, and 2016 are fed by transmission line pairs 2020, 2022, 2024, and 2026, the magnitudes and phases of which are designed to produce the appropriate polarization when a particular feed is active and when used in conjunction with its paired column linear array. Single pole, double throw RF switches 2030, 2032, 2034, and 2036 select which of the feeds are used. The common ports of these switches connect at vertical RF connection points 2040, 2042, 2044, and 2046 to another circuit board layer depicted in FIG. 22 at connection points 2110, 2112, 2114, and 2116. Additional phase is provided by back-to-back single pole, four throw RF switches 2120, 2122, 2124, and 2126. In some embodiments, these switches could instead be conventional phase shifters for narrowband implementations. A power divider/combiner 2130, such as a Wilkinson power divider/combiner, converges the four feeds into a single feed port 2140.

Figure 23:
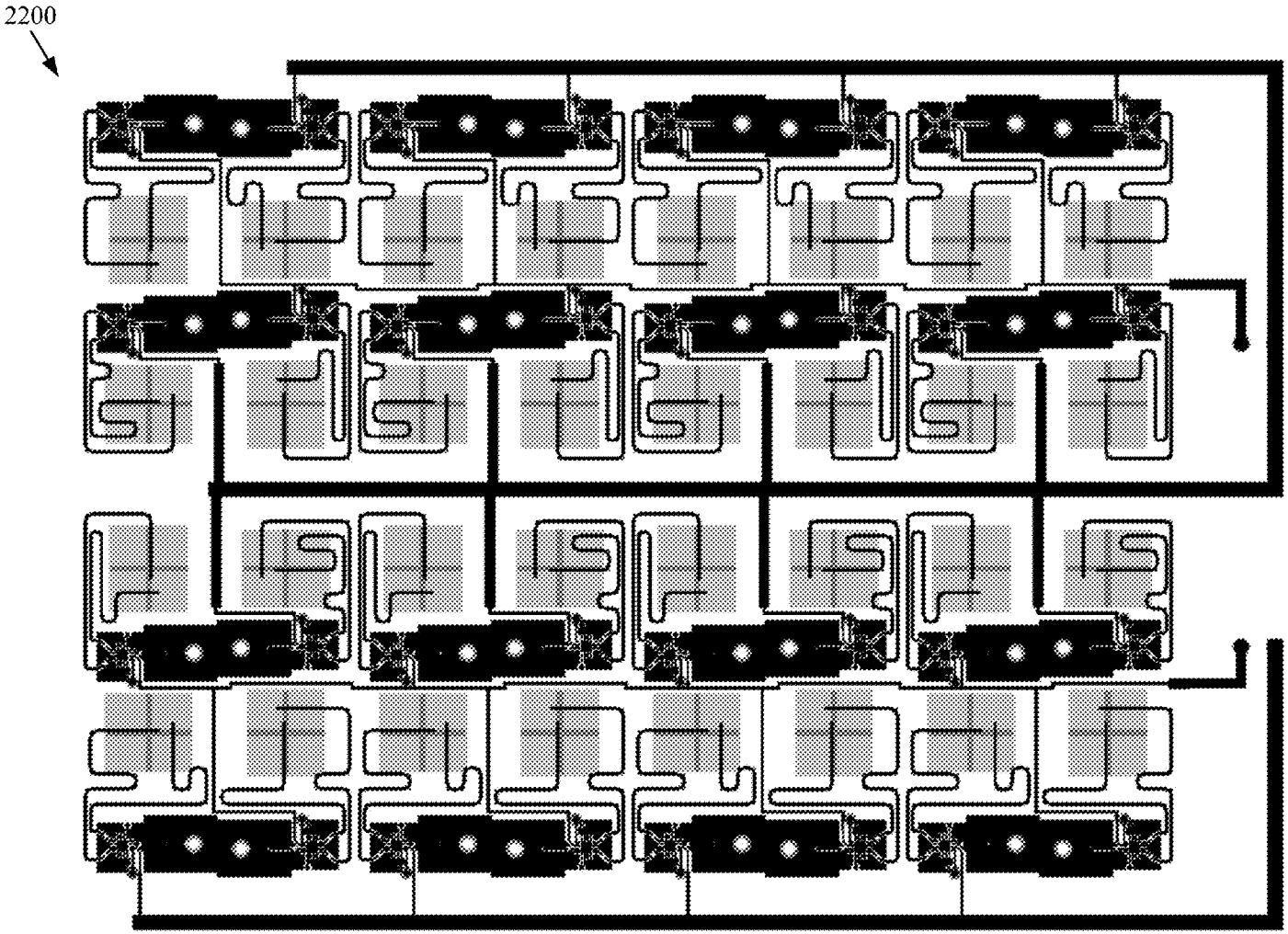
FIGS. 23 and 24 show diagrams of the prototype circuitry for the entire array and feed/switch/phase network as depicted in FIG. 20.
Figure 24:
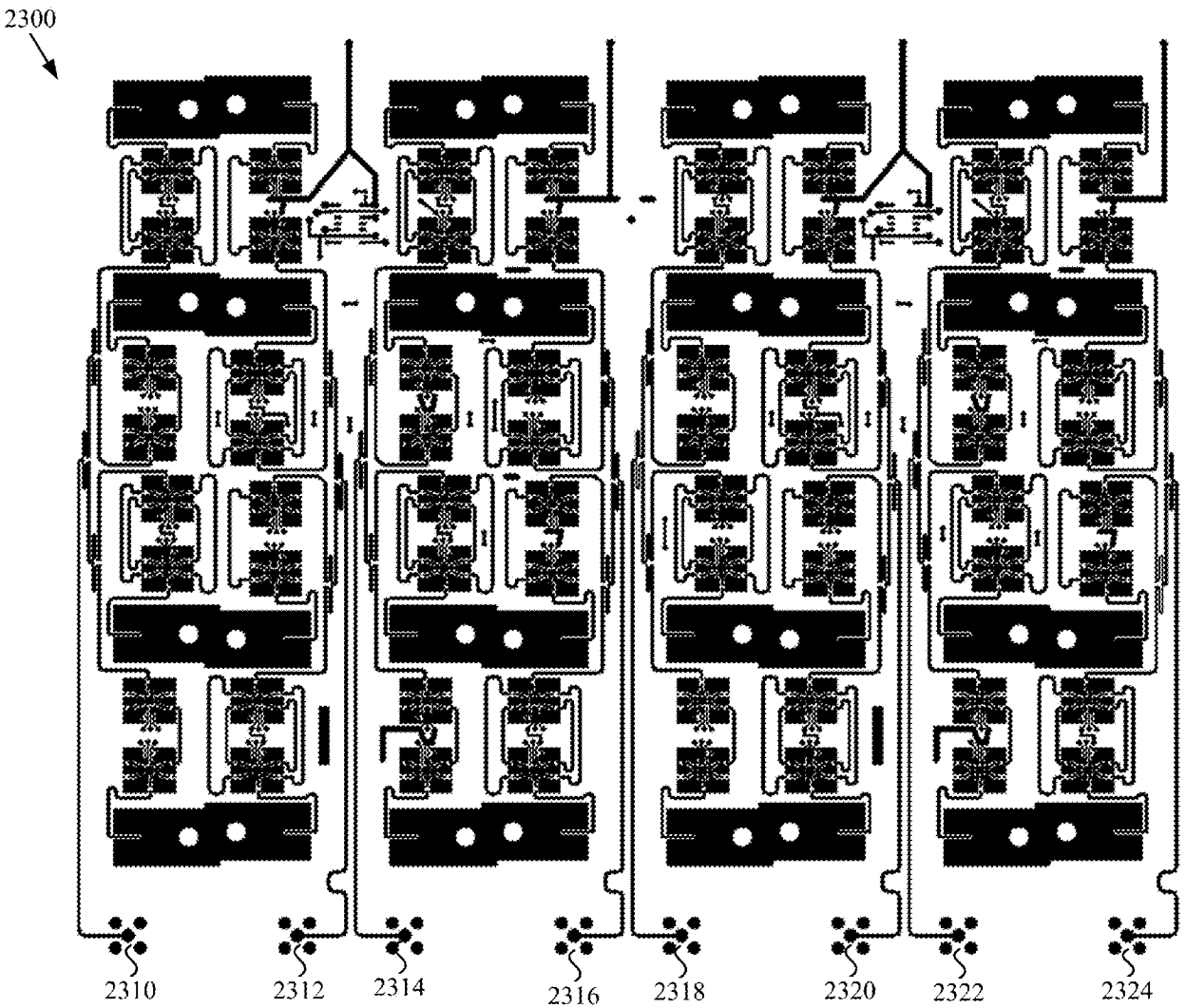

FIGS. 23 and 24 show diagrams 2200 and 2300 of the prototype circuitry for the entire array as depicted in FIG. 19 and several of the feed/switch/phase networks as depicted in FIG. 20. The eight common ports 2310-2314 of the full array may then be connected to a beam forming device such as an RF lens, Butler matrix, or phase shifter feed network to enable electronic steering of the beam in one dimension concurrent with independent of polarization reconfiguring.

An advantage of the embodiments of the invention shown in FIGS. 13-24 is the use of dual-fed, crossed-slot-coupled microstrip patch elements in a 2×2 sub-array, where the elements are progressively rotated. First, the feature of each element being 90° rotated relative to its vertical and horizontal neighbors means so that no two adjacent elements have similar center/offset feed orientations. When the sub-array is configured to radiate linear polarization, this reduces the performance disparity between the center- and offset-fed polarizations of the single element (vertical and horizontal in FIG. 13). For example, when radiating horizontal linear polarization, the sub-array is fed at ports 1317 (center), 1329 (offset), 1337 (center), and 1349 (offset).

An additional feature of the embodiments of this invention shown in FIGS. 13-24 is to generate circular polarization using the linear modes of each element in the sub-array. As described above, the differences between the two orthogonal feeds in the dual-fed, cross-slot-coupled microstrip patch antenna element cause poor axial ratio performance for circular polarization. Additionally, since the two feeds are close in proximity and share the same crossed slot, some components of the undesired circular polarization are generated, reducing the cross-polarization rejection. Thus, the advantage is better axial ratio and cross-polarization rejection when configured as a sub-array of progressively rotated elements. In simulation, the circular cross-polarization rejection for a single element was found to be 10-25 dB, whereas the rejection of the sub-array was 30-50 dB.

Other advantages of the embodiments of the invention shown in FIGS. 13-24 relate to its extension as a full array that can support spatial beam steering. Unlike other sub-array solutions, each element in the sub-array of the embodiments of the invention shown in FIGS. 13-24 can be independently fed. Since the elements are nominally a half wavelength or smaller in size, they are compatible with phased array applications that desire beam steering out to +/−45° or greater, depending on the array size. For applications that desire one-dimensional steering only, a simplified feed and compact form factor can be devised by RF combining all elements in a column, with the appropriate switching/phasing networks embedded in the feed structure to provide the desired polarization reconfigurability. Without this technique of splitting the sub-arrays into columns, the default design procedure would have each reconfigurable sub-array combine to a single feed and array with those feed points, which are now spaced one wavelength or greater and thus are not well suited for beam steering applications.

The wide bandwidth design of every aspect of the embodiments of the invention shown in FIGS. 13-24 is also advantageous. The radiating elements (aperture-coupled microstrip patches) support wide bandwidths. The phasing among elements is also done in a wideband fashion: multiples of quarter wavelength path lengths are used to generate 90°, 180°, and 270° phase shifts. Lastly, in the cases of the single sub-array or linear arrays comprising a full array, the prototypes described herein make use of corporate feed networks, which have equal path lengths to each branch and therefore avoid narrow bandwidth/frequency steering issues. The use of a Rotman or other RF lens to steer the full array extends the wide bandwidth performance into that aspect as well.

While some embodiments of the invention shown in FIGS. 13-24 use microstrip-fed, aperture-coupled patch antennas as the radiating elements, other embodiments may use stripline transmission lines and feeds, which have the benefit of reducing the thickness of the overall system by allowing trace layers to be separated only by thin dielectrics and a ground plane. In this case, integrated circuits and other circuit components will still need to be located on microstrip for placement and/or soldering issues.

In some embodiments, other dual-feed, wideband radiating elements may be used so long as their dimensions are small enough to allow arraying (dimensions roughly less than one wavelength). An example of such an element might consist of two electrically small dipoles that are orthogonally oriented, thus having two feeds and able to create every polarization option.

Many modifications and variations of the Wideband Planar Reconfigurable Polarization Antenna Array are possible in light of the above description. Within the scope of the appended claims, the embodiments of the systems described herein may be practiced otherwise than as specifically described. The scope of the claims is not limited to the implementations and the embodiments disclosed herein, but extends to other implementations and embodiments as may be contemplated by those having ordinary skill in the art.

We claim:

1. A system comprising:

at least a two-by-two array of linearly polarized antenna elements, wherein each antenna element has an orthogonal feed orientation with respect to its adjacent antenna elements, wherein each antenna element in the array is equally and progressively rotated in orientation with respect to its adjacent antenna elements;

a first array feed line connected to a first pair of elements in the array, wherein a first sub-feed line connected to the first array feed line is connected to a first element of the first pair of elements and a second sub-feed line connected to the first array feed line is connected to a second element of the first pair of elements, wherein the first and second elements of the first pair of elements have orthogonal feed orientations;

a second array feed line connected to a second pair of elements in the array, wherein the second array feed line is not combined with the first array feed line, wherein a first sub-feed line connected to the second array feed line is connected to a first element of the second pair of elements and a second sub-feed line connected to the second array feed line is connected to a second element of the second pair of elements, wherein the first and second elements of the second pair of elements have orthogonal feed orientations, wherein the first and second sub-feed lines connected to the first array feed line and the first and second sub-feed lines connected to the second array feed line each generate a corresponding equal and progressive phase delay within the array.

2. The system of claim 1, wherein the antenna elements are aperture coupled microstrip patch elements.

3. The system of claim 2, wherein the aperture coupled microstrip patch elements comprise a single slot fed by one of the sub-feed lines.

4. The system of claim 2, wherein the aperture coupled microstrip patch elements comprise a cross-slot, wherein the at least one sub-feed lines is two sub-feed lines, wherein the cross-slot of each aperture coupled microstrip patch element is fed by the two sub-feed lines.

5. The system of claim 4, wherein the amplitude and phase of the sub-feed lines for each antenna element are controlled by RF switches and phase shifters.

6. The system of claim 5, wherein the phase shifters are meandering transmission lines.

7. The system of claim 1, wherein each antenna element is equally and progressively rotated in orientation in one of a clockwise direction and a counter-clockwise direction.

8. A system comprising:

an array comprising a first sub-array and a second sub-array, each sub-array comprising at least a two-by-two array of linearly polarized antenna elements, wherein each antenna element in the sub-array has an orthogonal feed orientation with respect to its adjacent antenna elements and is equally and progressively rotated in orientation with respect to its adjacent antenna elements, a first sub-array feed line connected to a first pair of elements in the sub-array, wherein a first sub-feed line connected to the first sub-array feed line is connected to a first element of the first pair of elements and a second sub-feed line connected to the first sub-array feed line is connected to a second element of the first pair of elements, wherein the first and second elements of the first pair of elements have orthogonal feed orientations, and a second sub-array feed line connected to a second pair of elements in the sub-array, wherein the second sub-array feed line is not combined with the first sub-array feed line, wherein a first sub-feed line connected to the second sub-array feed line is connected to a first element of the second pair of elements and a second sub-feed line connected to the second sub-array feed line is connected to a second element of the second pair of elements, wherein the first and second elements of the second pair of elements have orthogonal feed orientations, wherein the first and second sub-feed lines connected to the first sub-array feed line and the first and second sub-feed lines connected to the second sub-array feed line each generate a corresponding equal and progressive phase delay within their respective sub-array, wherein the first pair of elements in the first sub-array and the first pair of elements in the second sub-array form a first linear array in the array, wherein the first sub-array feed line of the first sub-array is combined with the first sub-array feed line of the second sub-array and fed by a first feed line of the array, wherein the second pair of elements in the first sub-array and the second pair of elements in the second sub-array form a second linear array in the array, wherein the second sub-array feed line of the first sub-array is combined with the second sub-array feed line of the second sub-array and fed by a second feed line of the array, wherein the first feed line of the array is not combined with the second feed line of the array.

9. The system of claim 8, wherein the antenna elements are aperture coupled microstrip patch elements.

10. The system of claim 9, wherein the aperture coupled microstrip patch elements comprise a single slot fed by one of the sub-feed lines.

11. The system of claim 9, wherein the aperture coupled microstrip patch elements comprise a cross-slot, wherein the at least one sub-feed lines is two sub-feed lines, wherein the cross-slot of each aperture coupled microstrip patch element is fed by the two sub-feed lines.

12. The system of claim 11, wherein the two sub-feed lines for each of the aperture coupled microstrip patch elements in one of the separate lines of the array are power combined to two feed lines.

13. The system of claim 12, wherein the power-combined feed lines are connected to a beamformer to provide amplitude and phase to each feed line.

14. The system of claim 13, wherein the beamformer is an RF lens.

15. The system of claim 11, wherein the amplitude and phase of the two sub-feed lines for each aperture coupled microstrip patch element are controlled by RF switches and phase shifters.

16. The system of claim 15, wherein the phase shifters are meandering transmission lines.

17. The system of claim 8, wherein each antenna element is equally and progressively rotated in orientation in one of a clockwise direction and a counter-clockwise direction.

18. The system of claim 8, wherein the first and second linear arrays of the array are array rows.

19. The system of claim 8, wherein the first and second linear arrays of the array are array columns.

* * * * *